US012163402B2

(12) United States Patent
Passmore et al.

(10) Patent No.: US 12,163,402 B2
(45) Date of Patent: Dec. 10, 2024

(54) MAGNETICALLY COUPLED SUBSURFACE SAFETY VALVE

(71) Applicant: Halliburton Energy Services, Inc., Houston, TX (US)

(72) Inventors: Kevin Robin Passmore, Carrollton, TX (US); Bruce Edward Scott, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/836,237

(22) Filed: Jun. 9, 2022

(65) Prior Publication Data

US 2023/0399919 A1 Dec. 14, 2023

(51) Int. Cl.

| | |
|---|---|
| ***E21B 34/08*** | (2006.01) |
| ***E21B 23/02*** | (2006.01) |
| ***E21B 34/06*** | (2006.01) |
| ***E21B 34/10*** | (2006.01) |

(52) U.S. Cl.

CPC ..... *E21B 34/08* (2013.01); *E21B 23/02* (2013.01); *E21B 34/066* (2013.01); *E21B 34/105* (2013.01)

(58) Field of Classification Search

CPC ..... E21B 34/066; E21B 34/08; E21B 34/105; E21B 23/02

See application file for complete search history.

(56) References Cited

U.S. PATENT DOCUMENTS

| | | | |
|---|---|---|---|
| 4,066,128 | A | 1/1978 | Davis et al. |
| 4,176,717 | A | 12/1979 | Hix |
| 6,988,556 | B2 | 1/2006 | Vick, Jr. |
| 7,967,074 | B2 | 6/2011 | Lake et al. |
| 8,869,881 | B2 | 10/2014 | Vick, Jr. et al. |
| 8,919,730 | B2 | 12/2014 | Vick, Jr. et al. |
| 9,482,361 | B2 | 11/2016 | Petrangeli et al. |
| 9,784,083 | B2 | 10/2017 | Trautman et al. |
| 10,012,325 | B2 | 7/2018 | Bohaychuk et al. |
| 10,428,621 | B2 | 10/2019 | Purkis |

(Continued)

FOREIGN PATENT DOCUMENTS

| | | | |
|---|---|---|---|
| CN | 202850987 | U | 4/2013 |
| WO | 2011072121 | A2 | 6/2011 |

(Continued)

*Primary Examiner* — D. Andrews

(74) *Attorney, Agent, or Firm* — Scott Richardson; Parker Justiss, P.C.

(57) ABSTRACT

Provided is a retrievable safety valve insert. The retrievable safety valve insert, in one aspect, includes an outer housing having a central bore, and a valve closure mechanism coupled to the outer housing proximate a downhole end of the central bore. The retrievable safety valve insert, in accordance with this aspect, further includes a bore flow management actuator disposed in the central bore, the bore flow management actuator configured to slide to move the valve closure mechanism between a closed state and an open state, and one or more safety valve insert magnets coupled to the bore flow management actuator, the one or more safety valve insert magnets configured to magnetically couple with one or more landing nipple magnets of a safety valve landing nipple to slide the bore flow management actuator and move the valve closure mechanism between the closed state and the open state.

22 Claims, 25 Drawing Sheets

(56) References Cited

U.S. PATENT DOCUMENTS

| | | | |
|---|---|---|---|
| 10,480,283 | B2 | 11/2019 | Joseph et al. |
| 10,724,332 | B2 | 7/2020 | Henschel, Jr. et al. |
| 10,975,663 | B2 | 4/2021 | Kratochvil |
| 11,248,718 | B2 | 2/2022 | Lake |
| 11,713,987 | B2 | 8/2023 | Berntsen et al. |
| 2002/0108747 | A1 | 8/2002 | Dietz et al. |
| 2003/0221616 | A1 | 12/2003 | Carpenter et al. |
| 2009/0206290 | A1 | 8/2009 | Wygnanski |
| 2010/0025045 | A1 | 2/2010 | Lake et al. |
| 2011/0000684 | A1 | 1/2011 | Charles et al. |
| 2011/0240299 | A1 | 10/2011 | Vick, Jr. et al. |
| 2012/0006563 | A1 | 1/2012 | Patel et al. |
| 2014/0060803 | A1 | 3/2014 | Gano |
| 2015/0300124 | A1 | 10/2015 | Mailand et al. |
| 2018/0142534 | A1 | 5/2018 | Mailand et al. |
| 2018/0298726 | A1 | 10/2018 | Mailand et al. |
| 2019/0203564 | A1 | 7/2019 | Henschel, Jr. et al. |
| 2020/0032616 | A1 | 1/2020 | Vick, Jr. et al. |
| 2020/0032628 | A1* | 1/2020 | Orsini ..... E21B 4/003 |
| 2020/0248821 | A1 | 8/2020 | Parthasarathy et al. |
| 2020/0270965 | A1 | 8/2020 | Vick, Jr. et al. |
| 2020/0318458 | A1 | 10/2020 | Godfrey et al. |
| 2020/0386073 | A1 | 12/2020 | Joubran et al. |
| 2021/0095549 | A1 | 4/2021 | Hern et al. |
| 2021/0222522 | A1 | 7/2021 | Greci et al. |
| 2021/0246769 | A1 | 8/2021 | Burkart et al. |
| 2022/0099214 | A1 | 3/2022 | Peever |
| 2022/0178217 | A1 | 6/2022 | Egbe |
| 2022/0220834 | A1 | 7/2022 | Brown et al. |

FOREIGN PATENT DOCUMENTS

| | | | |
|---|---|---|---|
| WO | 2015016859 | A1 | 2/2015 |
| WO | 2020041056 | A1 | 2/2020 |
| WO | 2022186696 | A1 | 9/2022 |

* cited by examiner

MAGNETICALLY COUPLED SUBSURFACE SAFETY VALVE

BACKGROUND

Subsurface safety valves (SSSVs) are well known in the oil and gas industry and provide one of many failsafe mechanisms to prevent the uncontrolled release of subsurface production fluids, should a wellbore system experience a loss in containment. Typically, SSSVs comprise a portion of a tubing string, the entirety of the SSSVs being set in place during completion of a wellbore. Although a number of design variations are possible for SSSVs, the vast majority are flapper-type valves that open and close in response to longitudinal movement of a flow tube.

Since SSSVs provide a failsafe mechanism, the default positioning of the flapper valve is usually closed in order to minimize the potential for inadvertent release of subsurface production fluids. The flapper valve can be opened through various means of control from the earth's surface in order to provide a flow pathway for production to occur. What is needed in the art is an improved SSSV that does not encounter the problems of existing SSSVs.

BRIEF DESCRIPTION

Reference is now made to the following descriptions taken in conjunction with the accompanying drawings, in which.

Figure 6:
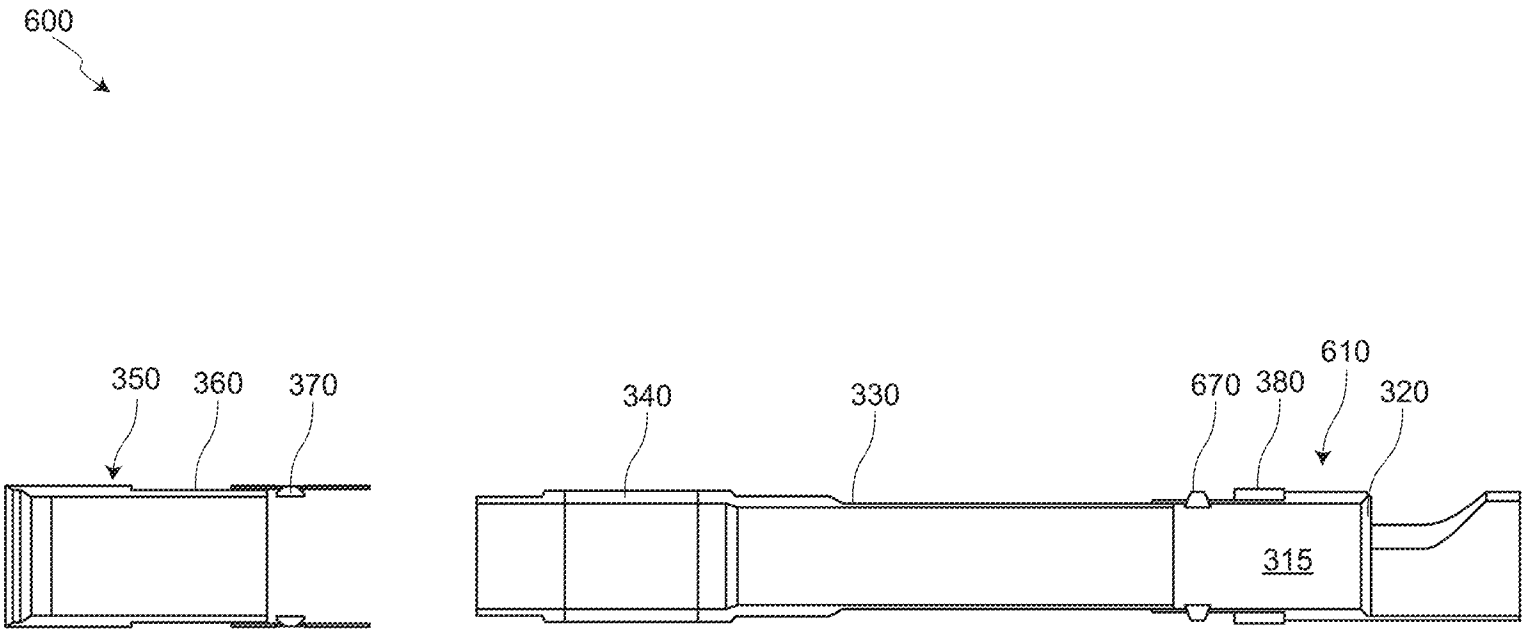

FIG. 6 illustrates one embodiment of a retrievable safety valve insert, as might form part of an SSSV (e.g., SSSV of FIG. 1), designed and manufactured according to an alternative embodiment of the present disclosure; and FIGS. 7A through 7K illustrate an embodiment for assembling (e.g., completing downhole) and operating a SSSV according to one or more alternative embodiments of the disclosure, including inserting and locking a retrievable safety valve insert within a safety valve landing nipple.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The present disclosure has acknowledged that offshore wells are being drilled at ever increasing water depths and in environmentally sensitive waters, and thus safety valves (e.g., including subsurface safety valves (SSSVs)) are necessary. The present disclosure has further acknowledged that SSSVs have inherent problems. For instance, the present disclosure has recognized that the operational lifespan of traditional SSSVs is less than optimal, whether they completely quit working or alternatively begin to leak. In such situations where the SSSVs completely stop working or alternatively begin to leak, the tubing string that the SSSVs are coupled to must be pulled out of hole, coupled to a new working SSSV, and then returned within the wellbore, which is an expensive and time consuming process.

Based, at least in part, on the foregoing acknowledgments and recognitions, the present disclosure has developed a replaceable SSSV (e.g., tubing string independent replaceable SSSV). The replaceable SSSV, in at least one embodiment, may be run in hole in two or more steps. For example, a safety valve landing nipple of the replaceable SSSV may first be run in hole with the tubing string, and then a retrievable safety valve insert may be run in hole (e.g., in either a single trip or two trips), and ultimately engage with the safety valve landing nipple to complete the replaceable SSSV. Accordingly, if the replaceable SSSV were to quit working or alternatively begin to leak, the original retrievable safety valve insert could easily be removed and replaced with a replacement retrievable safety valve insert. The process of switching original retrievable safety valve insert with the replacement retrievable safety valve insert is a much less expensive and much less time consuming process (e.g., can eliminate the need for a workover unit) than is currently necessary when pulling the tubing string, as discussed above.

SSSVs according to the disclosure may include hydraulic and/or electric actuation. For example, in at least one embodiment, the hydraulic and/or electric actuation moves a first magnet to compress a power spring in an isolated chamber in the safety valve landing nipple. As the first magnet is magnetically coupled to a second magnet associated with a bore flow management actuator (e.g., flow tube) of the retrievable safety valve insert, the hydraulic and/or electric actuation can be used to slide the bore flow management actuator to engage or disengage a valve closure mechanism (e.g., a flapper valve in one embodiment) to determine a flow condition of subsurface production fluids through the SSSV.

SSSVs according to the disclosure may also have increased failsafe ability as compared to other safety valves. Failsafe may be defined as a condition in which the SSSV or associated control system may be damaged and the SSSV retains the ability to close. In some examples, the SSSV may fail in a closed position (e.g., closed state), thus ensuring that wellbore fluids and pressure are contained. In another example, the SSSV may fail while in an open position (e.g., flow state), but closes automatically (e.g., using the power spring) when a hydraulic and/or electrical connection to the surface is damaged or severed without any additional external input.

Figure 1:
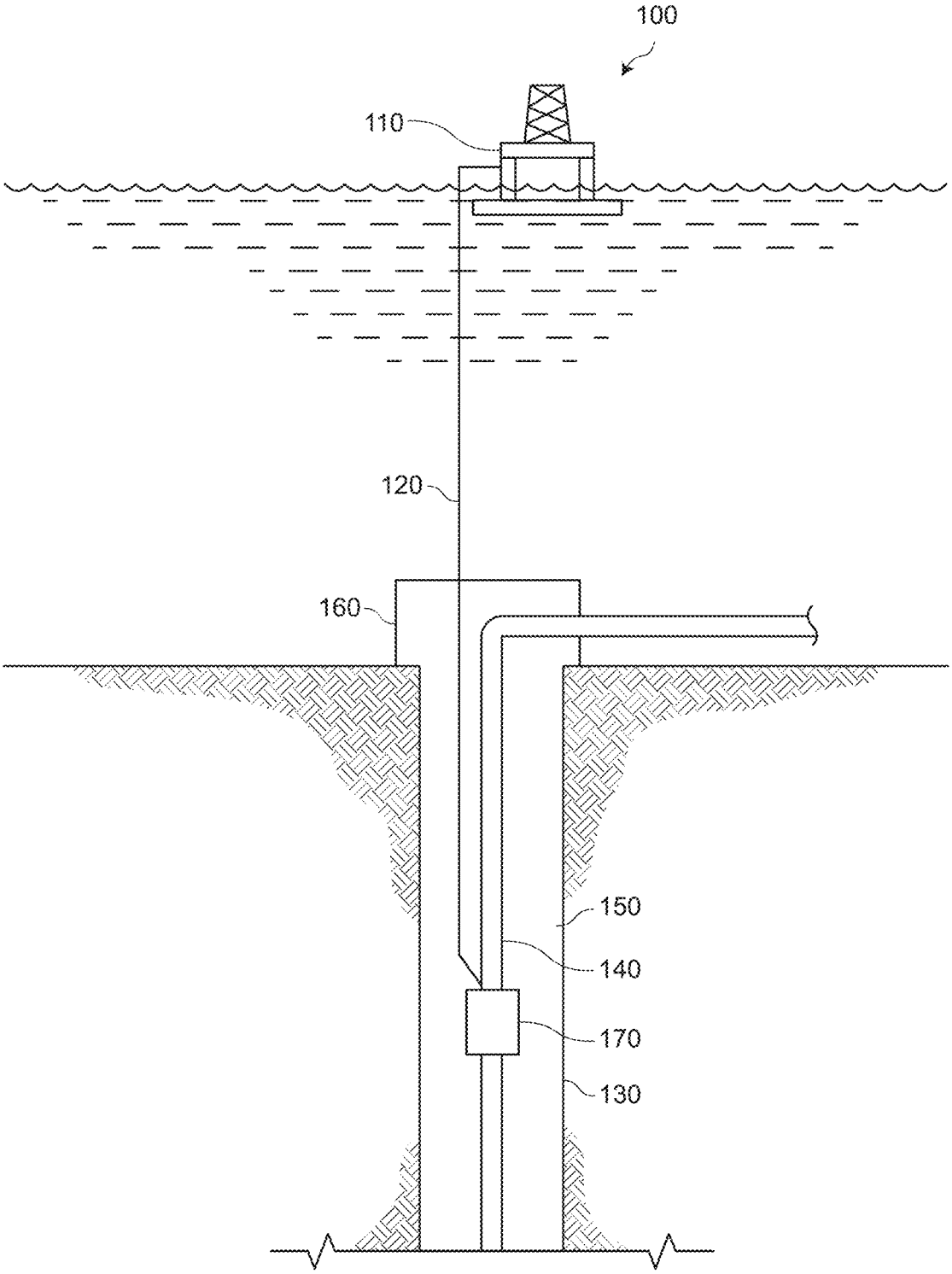
FIG. 1 illustrates a well system designed, manufactured and/or operated according to one or more embodiments of the disclosure.

FIG. 1 illustrates a well system 100 designed, manufactured and/or operated according to one or more embodiments of the disclosure. The well system 100, in at least one embodiment, includes an offshore platform 110 connected to an SSSV 170 via a control line 120 (e.g., hydraulic control line, electrical control line, etc.). An annulus 150 may be defined between walls of a wellbore 130 and a conduit 140. A wellhead 160 may provide a means to hand off and seal conduit 140 against the wellbore 130 and provide a profile to latch a subsea blowout preventer to. Conduit 140 may be coupled to the wellhead 160. Conduit 140 may be any conduit such as a casing, liner, production tubing, or other oilfield tubulars disposed in a wellbore.

The SSSV 170, or at least a portion thereof, may be interconnected in conduit 140 and positioned in the wellbore 130. Although the well system 100 is depicted in FIG. 1 as an offshore well system, one of ordinary skill should be able to adopt the teachings herein to any type of well, including onshore or offshore. The control line 120 may extend into the wellbore 130 and may be connected to the SSSV 170. The control line 120 may provide actuation power to the SSSV 170. As will be described in further detail below, power may be provided to the SSSV 170 to actuate or de-actuate the SSSV 170. Actuation may comprise opening the SSSV 170 to provide a flow path for subsurface production fluids to enter conduit 140, and de-actuation may comprise closing the SSSV 170 to close a flow path for subsurface production fluids to enter conduit 140. While the embodiment of FIG. 1 illustrates only a single SSSV 170, other embodiments exist wherein multiple SSSVs 170 according to the disclosure are used. Moreover, while not shown in the embodiment of FIG. 1, a tubing retrievable surface valve (TRSV) may be positioned downhole of the SSSV 170.

Figure 2:
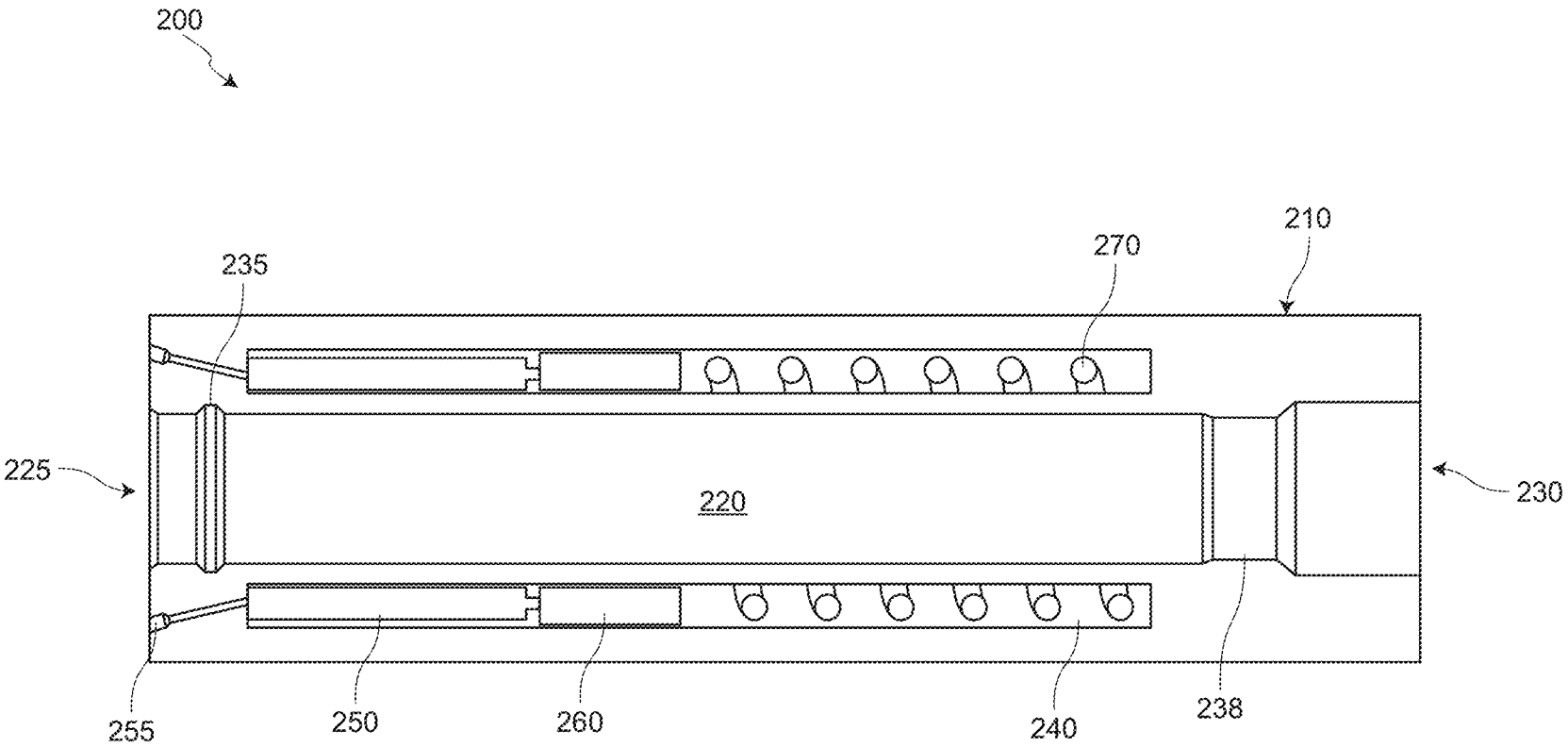
FIG. 2 illustrates one embodiment of a safety valve landing nipple, as might form part of an SSSV (e.g., SSSV of FIG. 1), designed and manufactured according to the present disclosure.

Turning now to FIG. 2, illustrated is one embodiment of a safety valve landing nipple 200, as might form part of an SSSV (e.g., SSSV 170 of FIG. 1), designed and manufactured according to the present disclosure. The safety valve landing nipple 200, in at least one embodiment, may be an integral part of a tubing retrievable SSSV, or in an alternative embodiment the safety valve landing nipple can be an independent device in the tubing string. The safety valve landing nipple 200, in at least one embodiment, includes a housing 210. The housing 210, in the illustrated embodiment, includes a passageway 220 extending from a first end 225 (e.g., uphole end) to a second end 230 (e.g., downhole end) thereof. While note shown in the embodiment of FIG. 2, the first and second ends 225, 230 may include coupling features (e.g., threaded coupling features), such that the safety valve landing nipple 200 may be coupled between adjacent ones of oilfield tubing (e.g., threaded tubing, production tubing, etc.).

In at least one embodiment, the safety valve landing nipple 200 further includes a latch profile 235 located in the passageway 220. The latch profile 235, in at least one embodiment, is a specifically designed latch profile configured to engage with a latch of a retrievable safety valve insert (e.g., the retrievable safety valve insert 300 of FIG. 3). In the illustrated embodiment, the latch profile 235 is located proximate the first end 225 (e.g., more near the first end 225 than near the second end 230). In at least one other embodiment, the safety valve landing nipple 200 further includes a polished bore receptacle 238. The polished bore receptacle 238, in at least one embodiment, is specifically configured to engage with a seal of a retrievable safety valve insert (e.g., the retrievable safety valve insert 300 of FIG. 3). In the illustrated embodiment, the polished bore receptacle 238 is located proximate the second end 230 (e.g., more near the second end 230 than near the first end 225).

The safety valve landing nipple 200 of FIG. 2, in at least one embodiment, additionally includes an isolated chamber 240. The isolated chamber 240, in the illustrated embodiment, is located in a sidewall of the housing 210 and is isolated from annulus and subsurface production fluids. In the illustrated embodiment of FIG. 2, an actuator 250 is positioned within the isolated chamber 240, and may be coupled to a control line (not shown) via one or more ports 255 in the housing 210. The actuator 250, in at least one embodiment, is a hydraulic actuator, and thus could be coupled to a hydraulic control line (e.g., hydraulic control line extending to the surface of the wellbore) via the one or more ports 255 in the housing. In yet another embodiment, the actuator 250 is an electric actuator, and thus could be coupled to an electric control line (e.g., TEC line extending to the surface of the wellbore) via the one or more ports 255 in the housing 210.

In the embodiment of FIG. 2, the safety valve landing nipple 200 additionally includes one or more landing nipple magnets 260 located within the isolated chamber 240, and coupled to the actuator 250. For example, movement of the actuator 250 between a first actuator state (e.g., unactuated state) and a second actuator state (e.g., actuated state) may be used to slide the one or more landing nipple magnets 260 between a first landing nipple magnet state (e.g., as shown in FIG. 2) and a second landing nipple magnet state (not shown). In at least one embodiment, the one or more landing nipple magnets 260 are permanent rare earth magnets. In yet another embodiment, however, the one or more landing nipple magnets 260 are electromagnets.

In the embodiment of FIG. 2, the safety valve landing nipple 200 additionally includes a power spring 270 located within the isolated chamber 240, and coupled (e.g., either directly or indirectly) to the one or more landing nipple magnets 260. The power spring 270, in at least one embodiment, is configured to return the one or more landing nipple magnets 260 from the second landing nipple magnet state to the first landing nipple magnet state when the actuator 250 is not powered. For example, if the power (e.g., hydraulic and/or electric power) to the actuator 250 were to be intentionally removed or reduced, the power spring 270 could move (e.g., whether independently or in conjunction with the actuator 250) the one or more landing nipple magnets 260 from the second landing nipple magnet state to the first landing nipple magnet state. Similarly, if the power (e.g., hydraulic and/or electric power) to the actuator 250 were to be unintentionally cut, the power spring 270 would act as a failsafe and move (e.g., independently) the one or more landing nipple magnets 260 from the second landing nipple magnet state to the first landing nipple magnet state.

Figure 3:
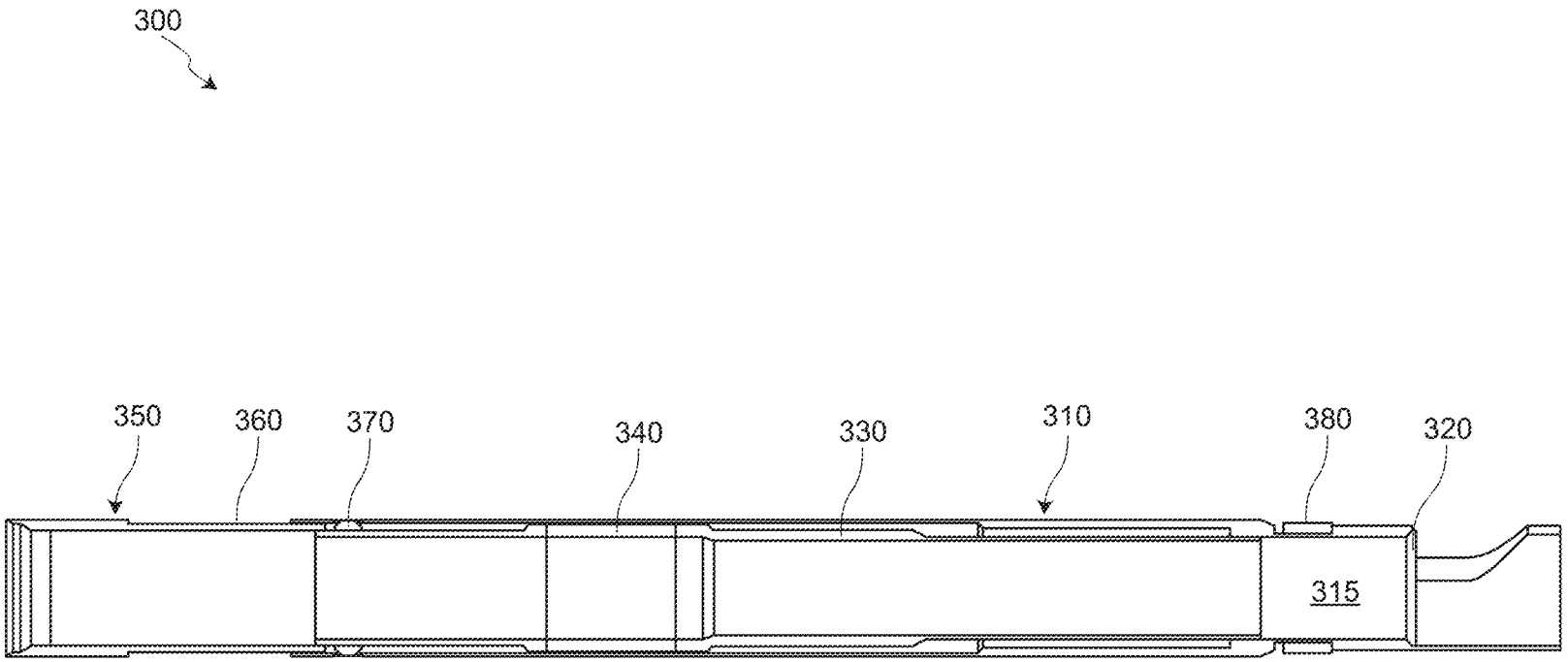
FIG. 3 illustrates one embodiment of a retrievable safety valve insert, as might form part of an SSSV (e.g., SSSV of FIG. 1), designed and manufactured according to the present disclosure.

Turning now to FIG. 3, illustrated is one embodiment of a retrievable safety valve insert 300, as might form part of an SSSV (e.g., SSSV 170 of FIG. 1), designed and manufactured according to the present disclosure. The retrievable safety valve insert 300, in at least one embodiment, could work in conjunction with a safety valve landing nipple (e.g., the safety valve landing nipple 200 of FIG. 2) to form an SSSV. The retrievable safety valve insert 300, in at least one embodiment, includes an outer housing 310. The outer housing 310, in one or more embodiments, comprises a central bore 315 extending axially therethrough, the central bore 315 operable to convey subsurface production fluids. In accordance with one or more embodiments of the disclosure, the retrievable safety valve insert 300 may additionally include a valve closure mechanism 320 disposed proximate a downhole end of the central bore 315. In at least one embodiment, the valve closure mechanism 320 is a flapper valve. Nevertheless, other types of valve closure mechanisms may be used and remain within the scope of the disclosure.

The retrievable safety valve insert 300 of the embodiment of FIG. 3 may additionally include a bore flow management actuator 330 disposed in the central bore 315. The bore flow management actuator 330, in the illustrated embodiment, is configured to move between a closed state and a flow state to engage or disengage the valve closure mechanism 320 to determine a flow condition of the subsurface production fluids through the central bore 315. For example, when the bore flow management actuator 330 is in a closed state, the valve closure mechanism 320 prevents the subsurface production fluids from accessing the central bore 315, and thus prevents the subsurface production fluids from exiting the wellbore. In contrast, when the bore flow management actuator 330 is in the flow state, the bore flow management actuator 330 slides down to prop the valve closure mechanism 320 open, and thus allows the subsurface production fluids to access the central bore 315, and thus allows the subsurface production fluids to exit the wellbore. The bore flow management actuator 330 may comprise many different features and remain within the scope of the disclosure. Nevertheless, in at least on embodiment, the bore flow management actuator 330 comprises a flow tube.

In accordance with the disclosure, the retrievable safety valve insert 300 may additionally include one or more safety valve insert magnets 340. For example, the one or more safety valve insert magnets 340 may be coupled to (e.g., integrated with) the bore flow management actuator 330. Accordingly, when the one or more safety valve insert magnets 340 move, the bore flow management actuator 330 moves. In at least one embodiment, the bore flow management actuator 330 moves in lock step with the one or more safety valve inert magnets 340.

In at least one embodiment, the one or more safety valve insert magnets 340 are configured to magnetically couple with one or more landing nipple magnets of the safety valve landing nipple (e.g., the one or more landing nipple magnets 260 of the safety valve landing nipple 200 of FIG. 2). Thus, as the one or more landing nipple magnets of the safety valve landing nipple move between a first landing nipple magnet state and a second landing nipple magnet state, being magnetically coupled thereto, the one or more safety valve insert magnets 340 move between a first safety valve insert magnet state and a second safety valve insert magnet state. Accordingly, the movement of the one or more landing nipple magnets of the safety valve landing nipple between the first landing nipple magnet state and the second landing nipple magnet state ultimately moves the bore flow management actuator 330 between the closed state and flow state, thereby moving the valve closure mechanism 320 between an open state and a closed state.

In accordance with the disclosure, the retrievable safety valve insert 300 may additionally include a landing nipple locking feature 350. The landing nipple locking feature 350, in one or more embodiments, is configured to engage (e.g., removably engage) with a safety valve landing nipple (e.g., the latch profile 235 of the safety valve landing nipple 200 of FIG. 2). Thus, when the landing nipple locking feature 350 of the retrievable safety valve insert 300 is engaged with the safety valve landing nipple (e.g., the latch profile 235 of the safety valve landing nipple 200 of FIG. 2), the SSSV is assembled, and thus may operate to allow or prevent subterranean production fluid from exiting the wellbore. Unique to the present disclosure, the landing nipple locking feature 350 may be moved (e.g., for example using wireline, slickline, coiled tubing, a wellbore tractor, etc.) between the engaged and disengaged state, and thus may allow the retrievable safety valve insert 300 to be easily insert within the safety valve landing nipple, easily removed from the safety valve landing nipple, or alternatively a replacement retrievable safety valve insert may be easily insert within the safety valve landing nipple, as discussed above.

The landing nipple locking feature 350, in one or more embodiments, includes a sliding sleeve 360, as well as one or more locking features 370. In the illustrated embodiment, the sliding sleeve 360 extends at least partially around, and may slide relative to, the bore flow management actuator 330. Furthermore, the locking features 370, in one or more embodiments, are movable from a radially retracted state to a radially extended state (e.g., extending through one or more openings in the outer housing 310). For example, in at least one embodiment, as the sliding sleeve slides relative to the bore flow management actuator 330, the sliding sleeve 360 engages a radially interior surface of the locking feature 370 to move the locking feature from the radially retracted state to the radially extended state. When the retrievable safety valve insert 300 is appropriately positioned within a safety valve landing nipple (e.g., the safety valve landing nipple 200 of FIG. 2), the movement of the sliding sleeve 360 moves the locking feature 370 from the radially retracted state to the radially extended state engaged with a latch profile (e.g., the latch profile 235 of FIG. 2) in the safety valve landing nipple. In the illustrated embodiment, the landing nipple locking feature 350 extends within, and in certain embodiments forms a portion of the outer housing 310 and/or bore flow management actuator 330. Other embodiments exist, however, where the landing nipple locking feature 350 does not extend within or form a portion of the outer housing 310 and/or bore flow management actuator 330. For example, the landing nipple locking feature 350, in certain embodiments, forms a separate distinct feature from the bore flow management actuator 330.

In accordance with the disclosure, the retrievable safety valve insert 300 may additionally include one or more seals 380. In at least one embodiment, the one or more seals 380 are one or more stacked seals that engage with a surface of the safety valve landing nipple. In at least one other embodiment, the one or more seals 380 are one or more stacked seals that engage with a polished bore receptacle (e.g., polished bore receptacle 238 of FIG. 2) of the safety valve landing nipple. In yet other embodiments, the one or more seals 380 are thermoplastic, elastomeric, or metal-to-metal seals, among others.

Turning now to FIGS. 4A through 4I, illustrated is an embodiment for assembling (e.g., completing downhole) and operating a SSSV 400 according to one or more embodiments of the disclosure, including inserting and locking a retrievable safety valve insert 420*a* within a safety valve landing nipple 410. In the illustrated embodiment of FIGS. 4A through 4I, the safety valve landing nipple 410 is similar in many respects to the safety valve landing nipple 200 of FIG. 2, and thus like reference numbers have been used to indicate similar, if not identical, features. Similarly, in the illustrated embodiment of FIGS. 4A through 4I, the retrievable safety valve insert 420*a* is similar in many respects to the retrievable safety valve insert 300 of FIG. 3, and thus like reference numbers have been used to indicate similar, if not identical, features. While not illustrated, the safety valve landing nipple 410 might be interconnected between pairs of oilfield tubulars, for example between pairs of threaded joint tubing. Furthermore, while not shown, a downhole conveyance, such as wireline, slickline, coiled tubing, a wellbore tractor, etc. may be coupled to the retrievable safety valve insert 420*a* for placing, securing and retrieving the retrievable safety valve insert 420*a* within/from the safety valve landing nipple 410.

Figure 4A:
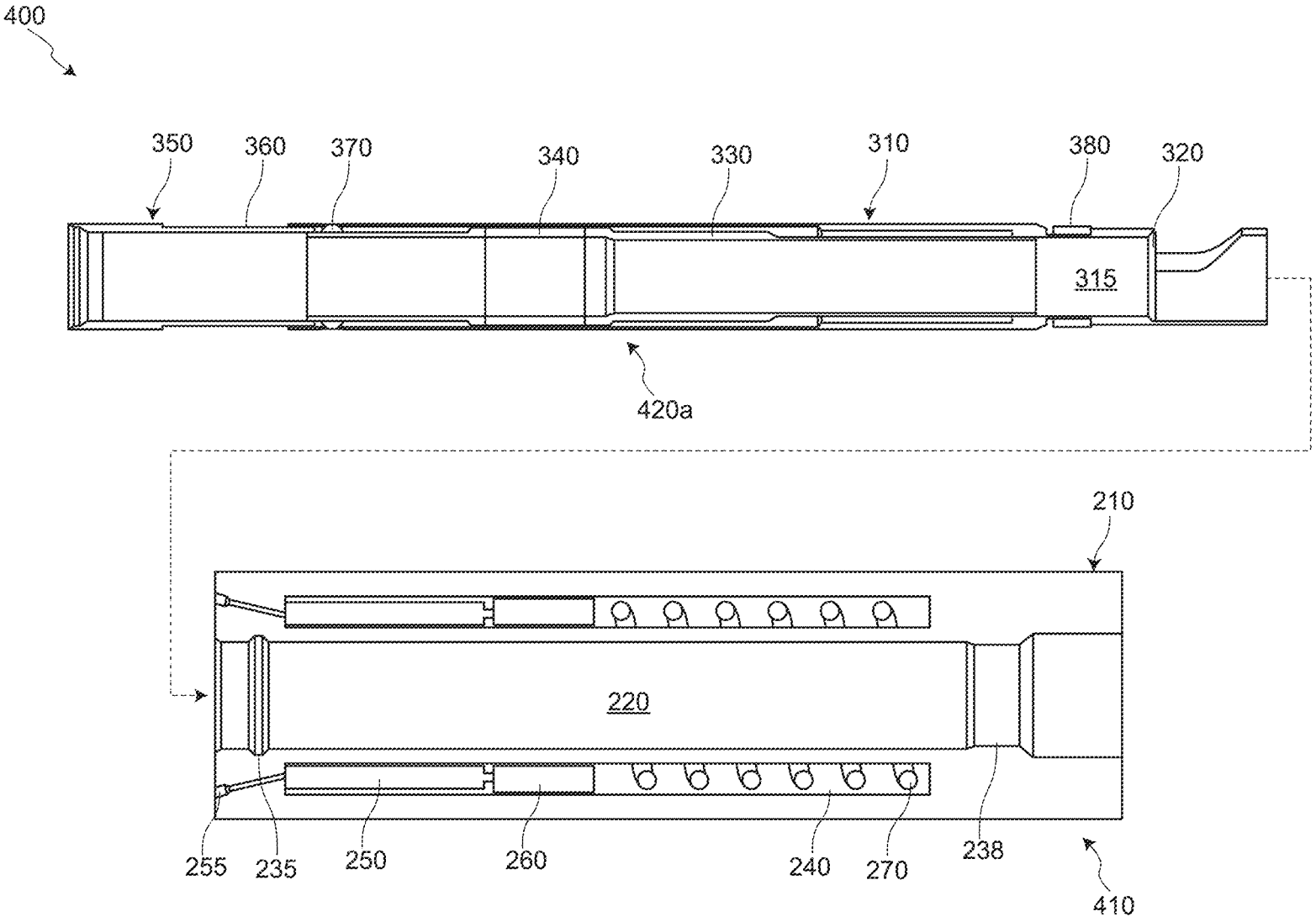
FIGS. 4A through 4I illustrate an embodiment for assembling (e.g., completing downhole) and operating a SSSV according to one or more embodiments of the disclosure, including inserting and locking a retrievable safety valve insert within a safety valve landing nipple.

Referring to FIG. 4A, the safety valve landing nipple 410 and the retrievable safety valve insert 420*a* are separate from one another, for example as they might be positioned as the retrievable safety valve insert 420*a* were travelling down the wellbore toward the safety valve landing nipple 410. As shown in the embodiment of FIG. 4A, the actuator 250 of the safety valve landing nipple 410 is in a first actuator state. As further shown in the embodiment of FIG. 4A, the valve closure mechanism 320 and the bore flow management actuator 330 of the retrievable safety valve insert 420*a* are in the closed state. Furthermore, the one or more locking features 370 of the retrievable safety valve insert 420*a* may be in the radially retracted state, as the sliding sleeve 360 has yet to slide to move the one or more locking features 370 to the radially extended state.

Figure 4B:
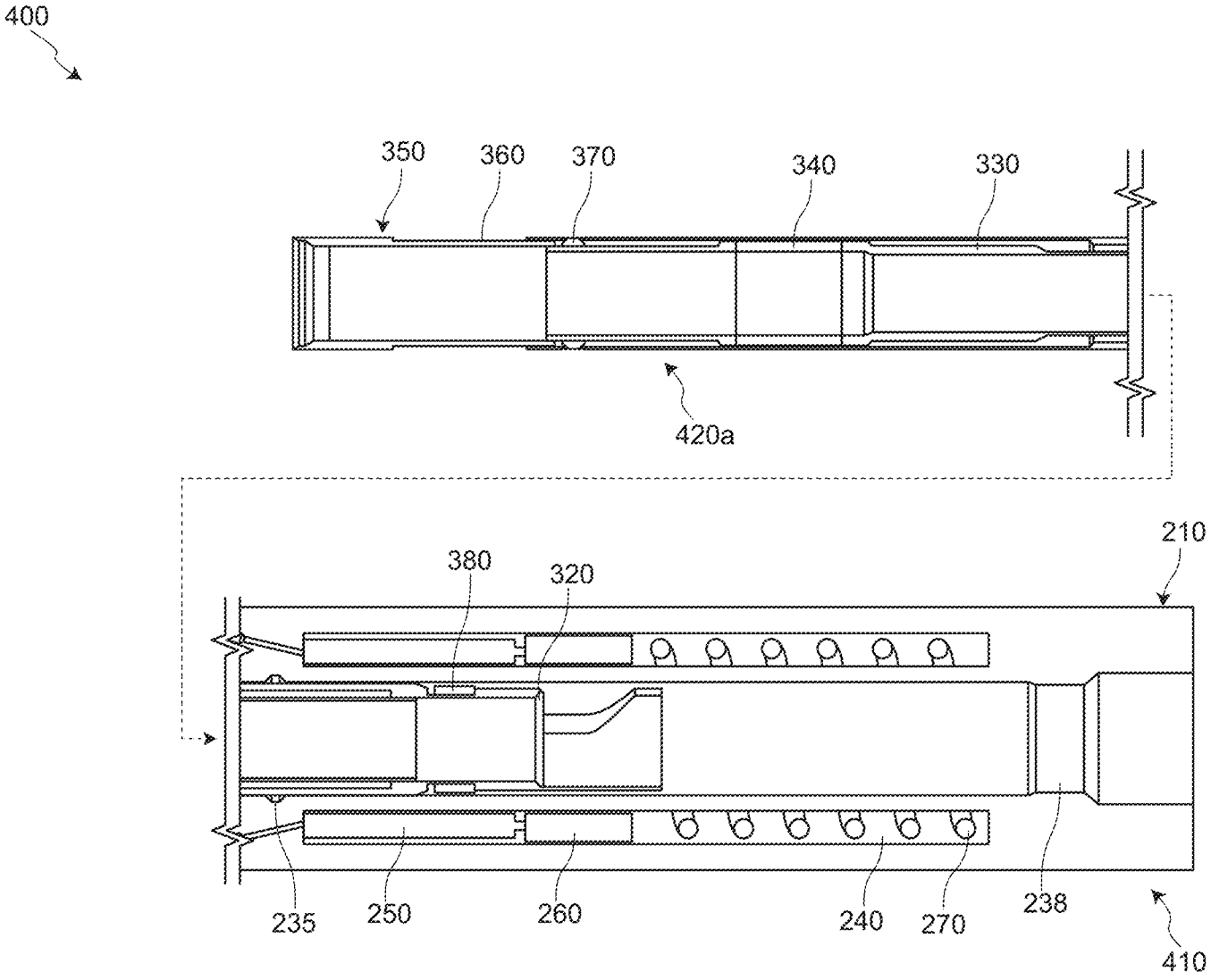

Referring to FIG. 4B, illustrated is the SSSV 400 of FIG. 4A after a small portion of the retrievable safety valve insert 420*a* has entered the safety valve landing nipple 410. In the embodiment of FIG. 4B, a downhole end of the retrievable safety valve insert 420*a* is approaching the one or more landing nipple magnets 260. The safety valve landing nipple 410 and the retrievable safety valve insert 420*a* are in substantially the same operational configuration in FIG. 4B as they were in FIG. 4A, but for the small portion of the retrievable safety valve insert 420*a* having entered the safety valve landing nipple 410.

Figure 4C:
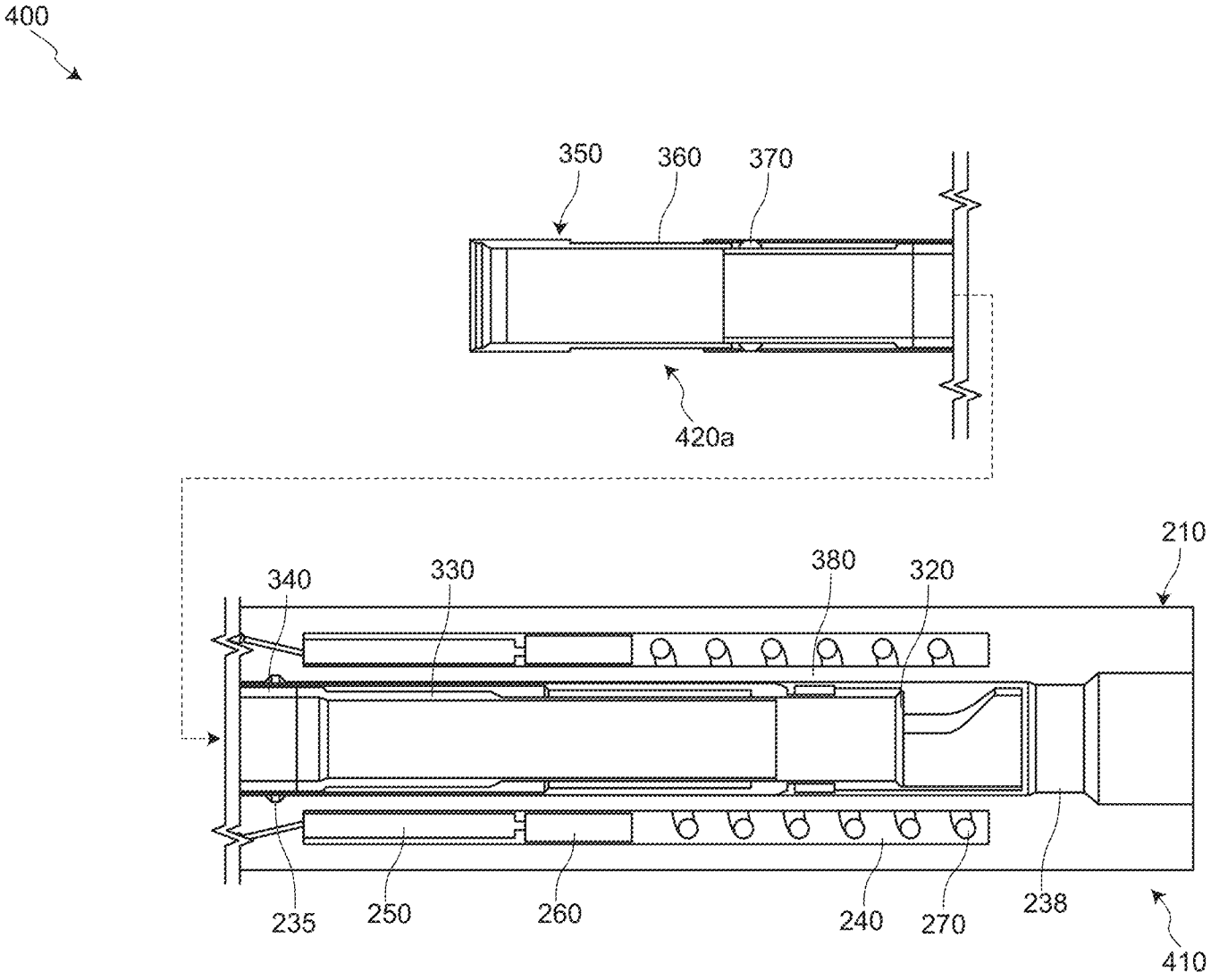

Referring to FIG. 4C, illustrated is the SSSV 400 of FIG. 4B after a significant portion of the retrievable safety valve insert 420*a* has entered the safety valve landing nipple 410. In the embodiment of FIG. 4C, a downhole end of the retrievable safety valve insert 420*a* is approaching the polished bore receptacle 238. The safety valve landing nipple 410 and the retrievable safety valve insert 420*a* are in substantially the same operational configuration in FIG. 4C as they were in FIG. 4B, but for the significant portion of the retrievable safety valve insert 420*a* having entered the safety valve landing nipple 410.

Figure 4D:
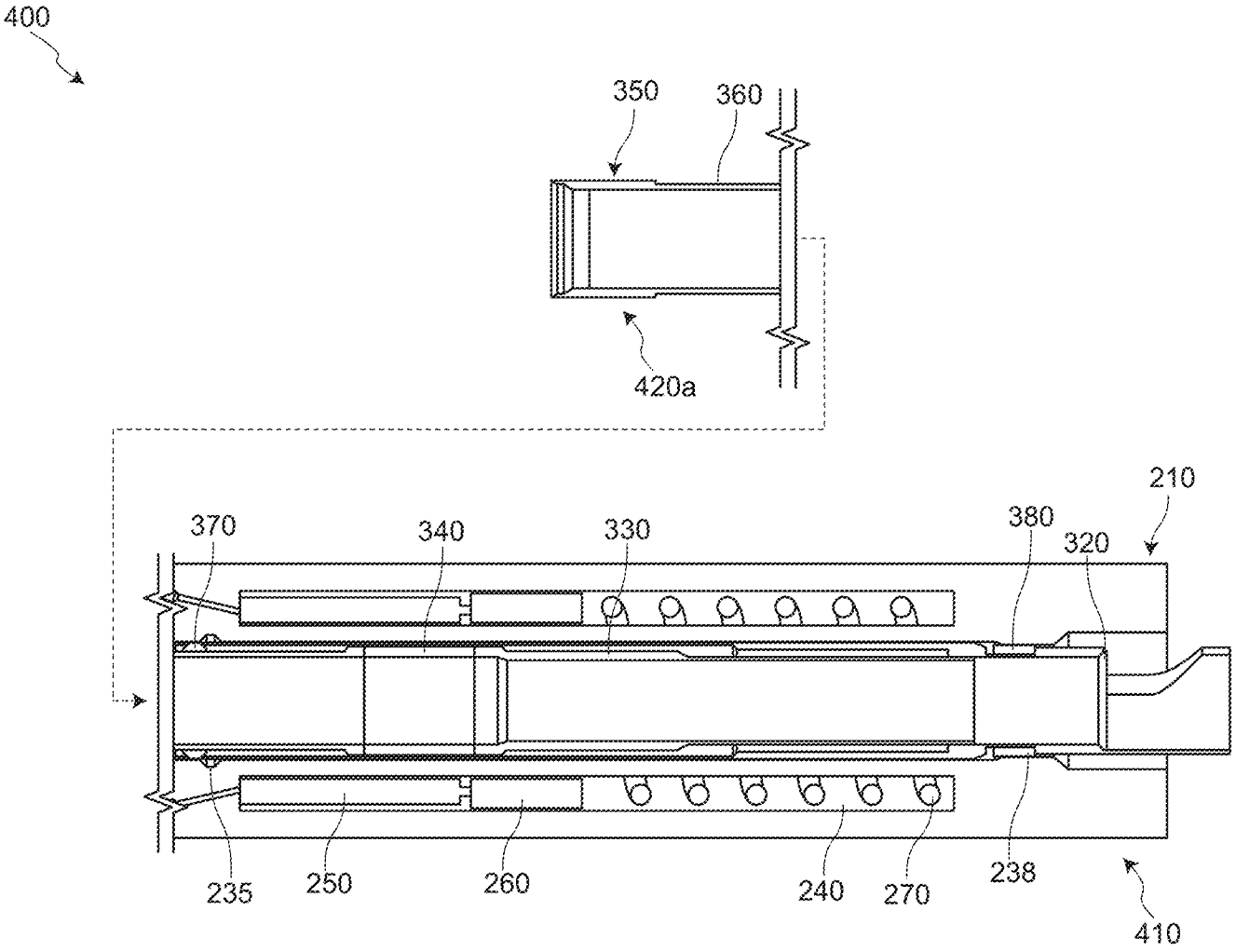

Referring to FIG. 4D, illustrated is the SSSV 400 of FIG. 4C after almost all of the retrievable safety valve insert 420*a* has entered the safety valve landing nipple 410. In the embodiment of FIG. 4D, the locking feature 370 is approaching the latch profile 235. The safety valve landing nipple 410 and the retrievable safety valve insert 420*a* are in substantially the same operational configuration in FIG. 4D as they were in FIG. 4C, but for almost all of the retrievable safety valve insert 420*a* having entered the safety valve landing nipple 410.

Figure 4E:
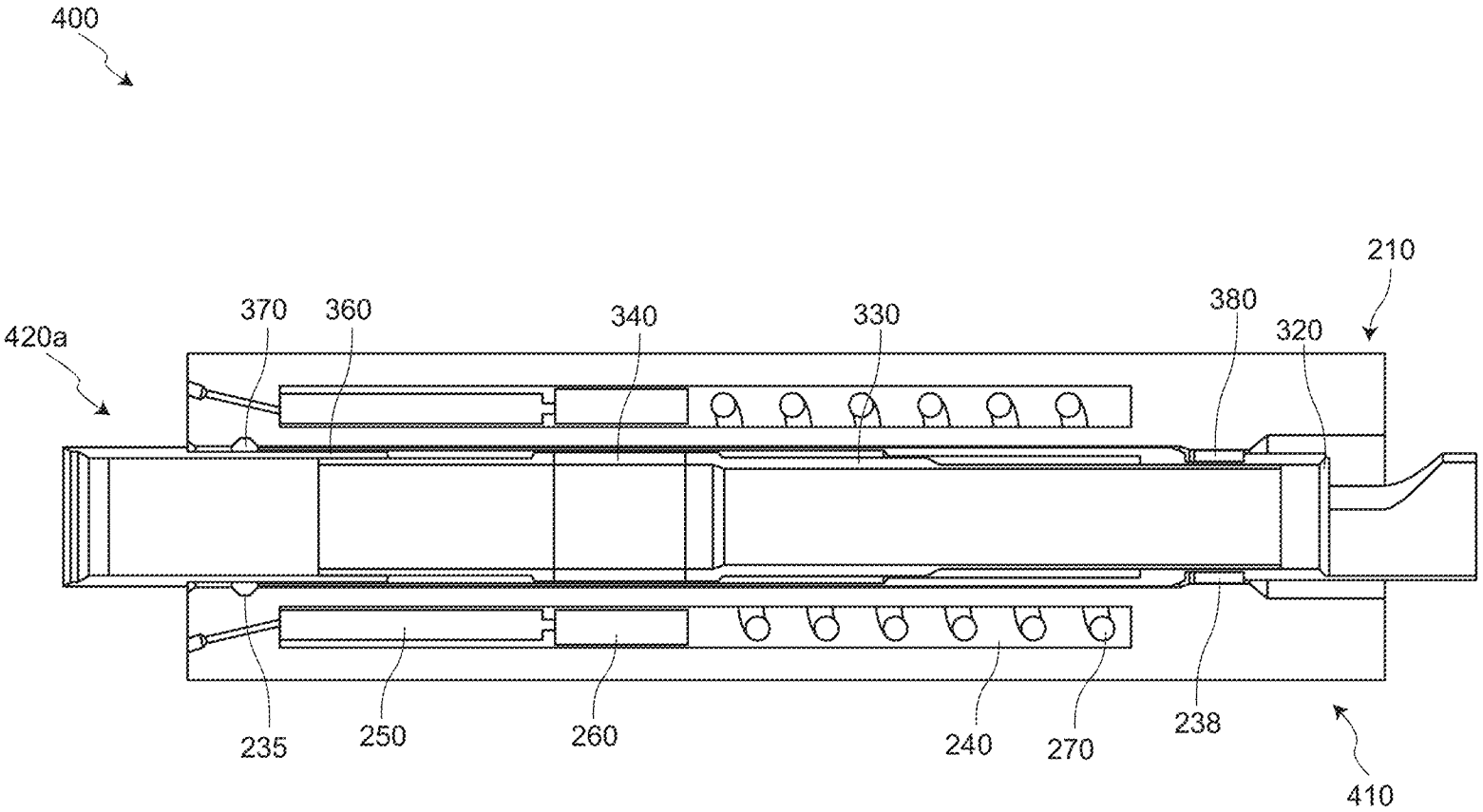

Referring to FIG. 4E, illustrated is the SSSV 400 of FIG. 4D after the locking feature 370 is located under the latch profile 235, and the sliding sleeve 360 has slid down moving the locking feature 370 from the radially retracted state to the radially extended state. Accordingly, the locking feature 370 now engages with the latch profile 235. Furthermore, the one or more safety valve insert magnets 340 are now magnetically coupled to the one or more landing nipple magnets 260. Additionally, the one or more seals 380 are in sealing engagement with the polished bore receptacle 238. Accordingly, the SSSV 400 is now assembled and operational.

Figure 4F:
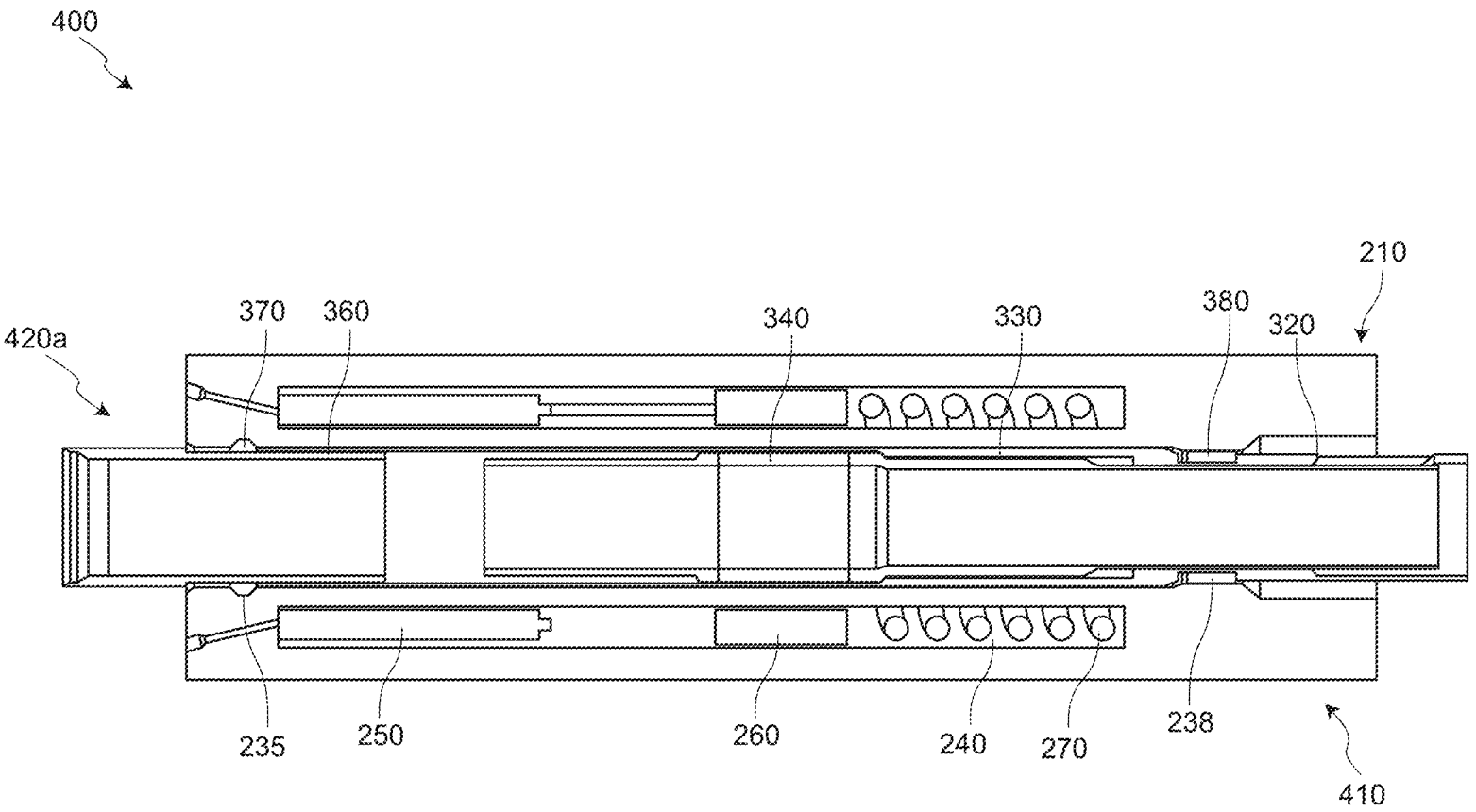

Referring to FIG. 4F, illustrated is the SSSV 400 of FIG. 4E after the actuator 250 has moved from the first actuator state to the second actuator state. In doing so, the actuator 250 has moved the one or more landing nipple magnets 260 from the first landing nipple magnet state to the second landing nipple magnet state. Moreover, as the one or more safety valve insert magnets 340 are magnetically coupled to the one or more landing nipple magnets 260, the one or more safety valve insert magnets 340 move from the first safety valve insert magnet state to the second safety valve insert magnet state. Additionally, as the bore flow management actuator 330 is coupled to the one or more safety valve insert magnets 340, the bore flow management actuator 330 moves from the closed state to the open state, the open state allowing subterranean production fluid to travel through the SSSV 400.

Figure 4G:
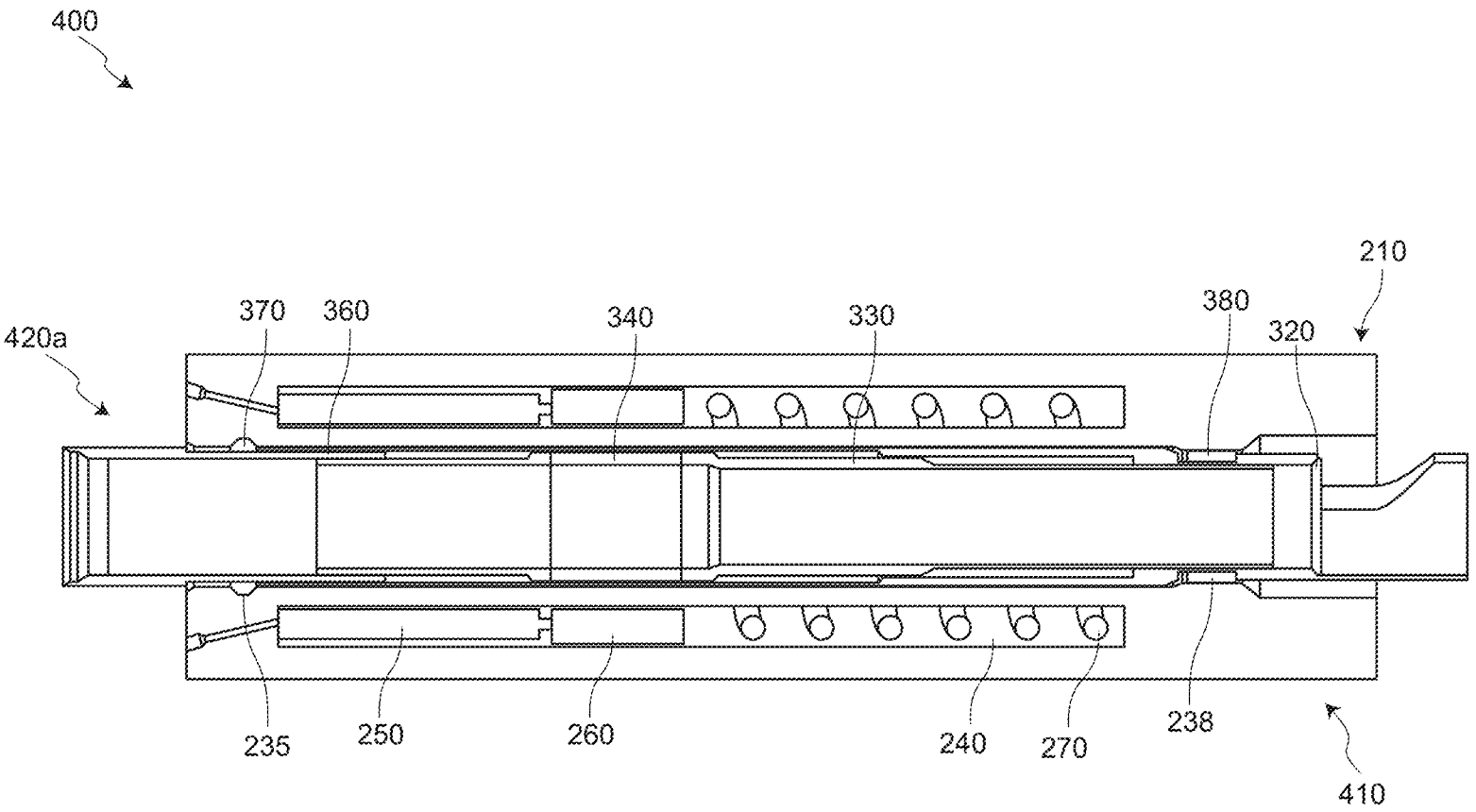

Referring to FIG. 4G, illustrated is the SSSV 400 of FIG. 4F after the actuator 250 has moved from the second actuator state back to the first actuator state. In doing so, the actuator 250 (e.g., and/or the power spring 270) has moved the one or more landing nipple magnets 260 from the second landing nipple magnet state back to the first landing nipple magnet state. Moreover, as the one or more safety valve insert magnets 340 are magnetically coupled to the one or more landing nipple magnets 260, the one or more safety valve insert magnets 340 move from the second safety valve insert magnet state back to the first safety valve insert magnet state. Additionally, as the bore flow management actuator 330 is coupled to the one or more safety valve insert magnets 340, the bore flow management actuator 330 moves from the open state back to the closed state, the closed state preventing subterranean production fluid from travelling through the SSSV 400.

In at least one embodiment, the power spring 270 is configured to return the one or more landing nipple magnets 260 from the second landing nipple magnet state to the first landing nipple magnet state when the actuator 250 is not powered. For example, if the power (e.g., hydraulic and/or electric power) to the actuator 250 were to be intentionally removed or reduced, the power spring 270 could move (e.g., whether independently or in conjunction with the actuator 250) the one or more landing nipple magnets 260 from the second landing nipple magnet state to the first landing nipple magnet state. Similarly, if the power (e.g., hydraulic and/or electric power) to the actuator 250 were to be unintentionally cut, the power spring 270 would act as a failsafe and move (e.g., independently) the one or more landing nipple magnets 260 from the second landing nipple magnet state to the first landing nipple magnet state.

Figure 4H:
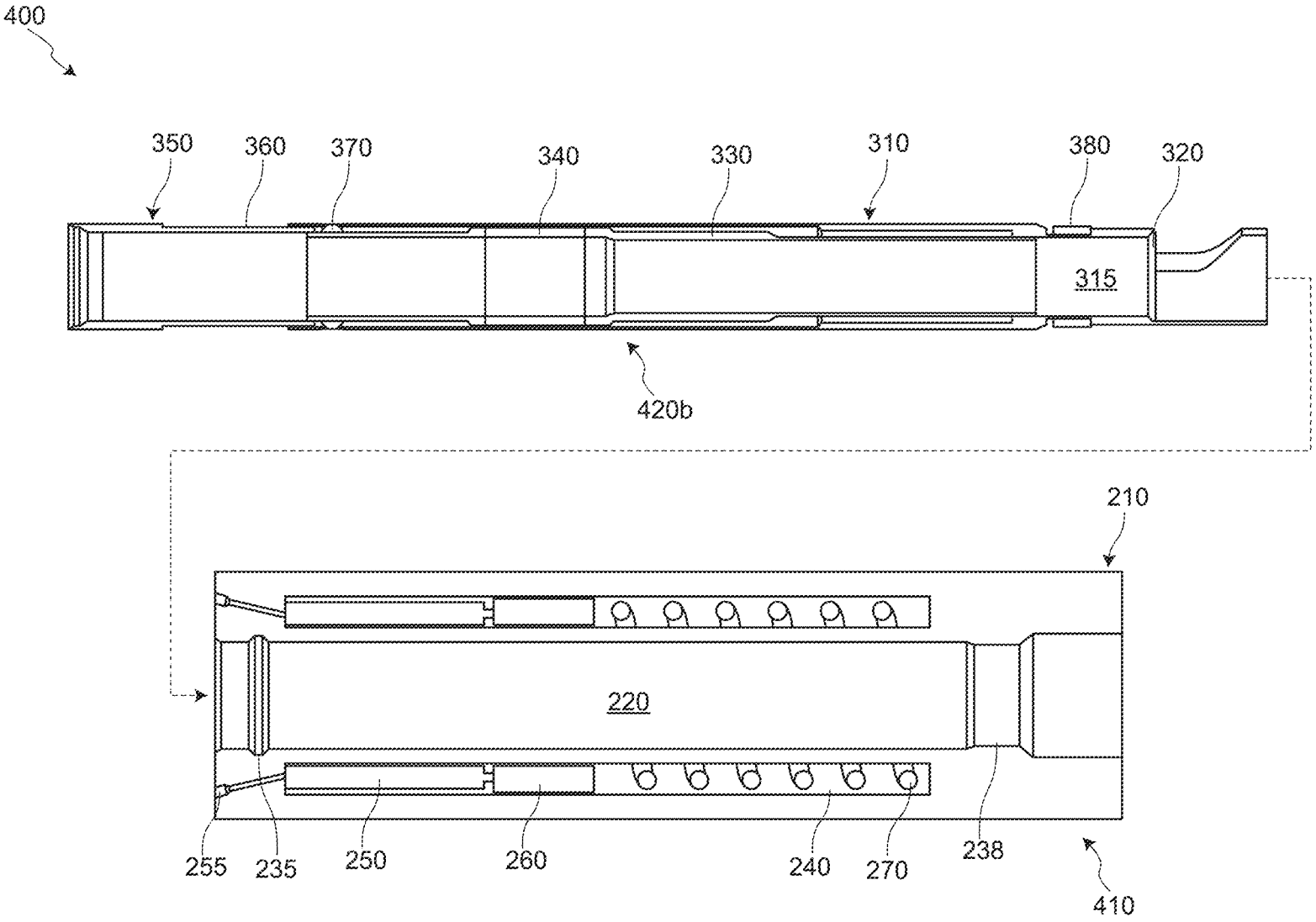

Referring to FIG. 4H, illustrated is the SSSV 400 of FIG. 4G after the retrievable safety valve insert 420*a* has been removed from the safety valve landing nipple 410, and a replacement retrievable safety valve insert 420*b* is being installed within the safety valve landing nipple 410. The replacement retrievable safety valve insert 420*b* is similar in many respects to the retrievable safety valve insert 420*a*. Accordingly, like reference numbers have been used to indicate similar, if not identical, features.

Figure 4I:
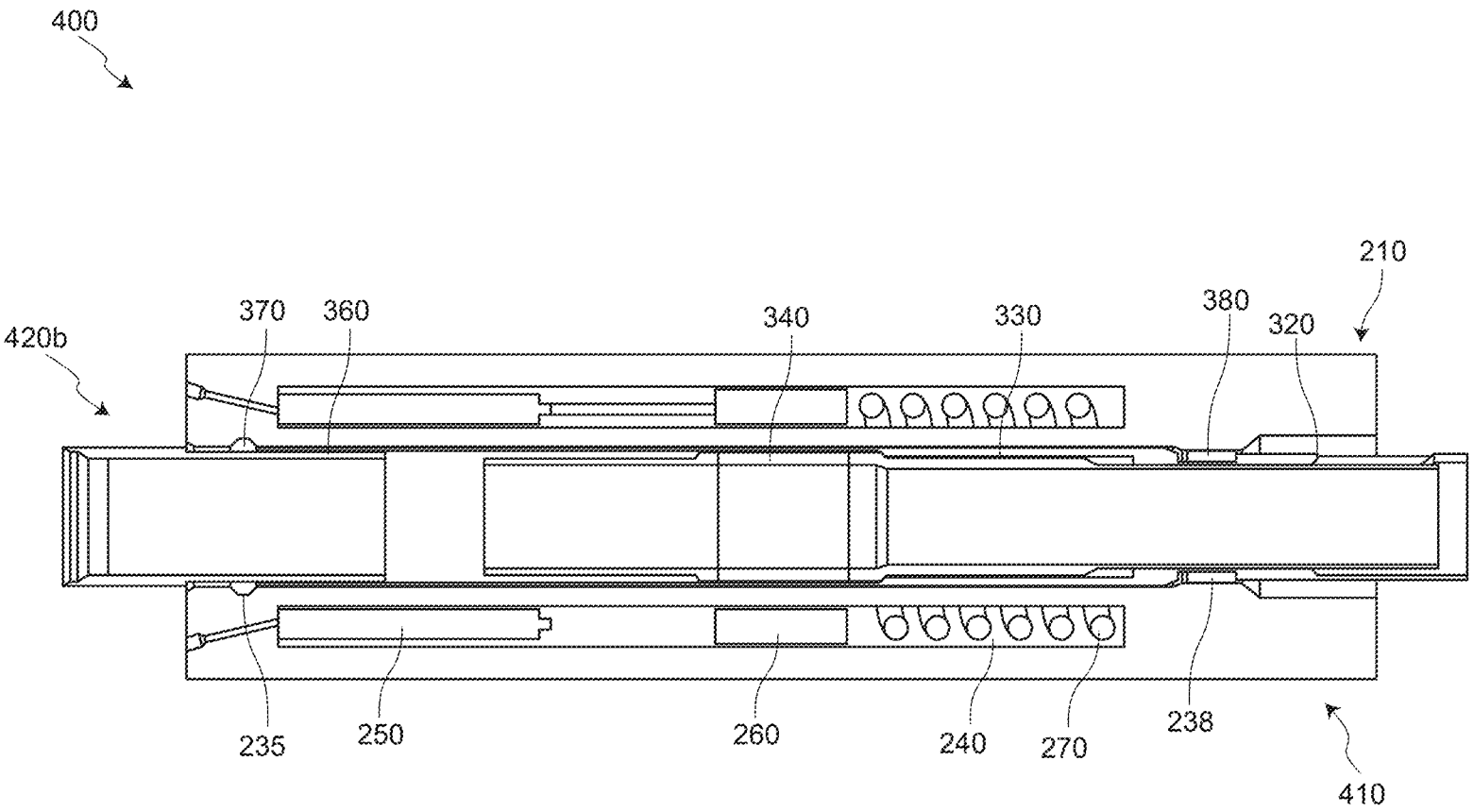

Referring to FIG. 4I, illustrated is the SSSV 400 of FIG. 4H after the replacement retrievable safety valve insert 420*b* is fully assembled within the safety valve landing nipple 410. Accordingly, the SSSV 400 is now assembled and operational with the replacement retrievable safety valve insert 420*b*.

Figure 5:
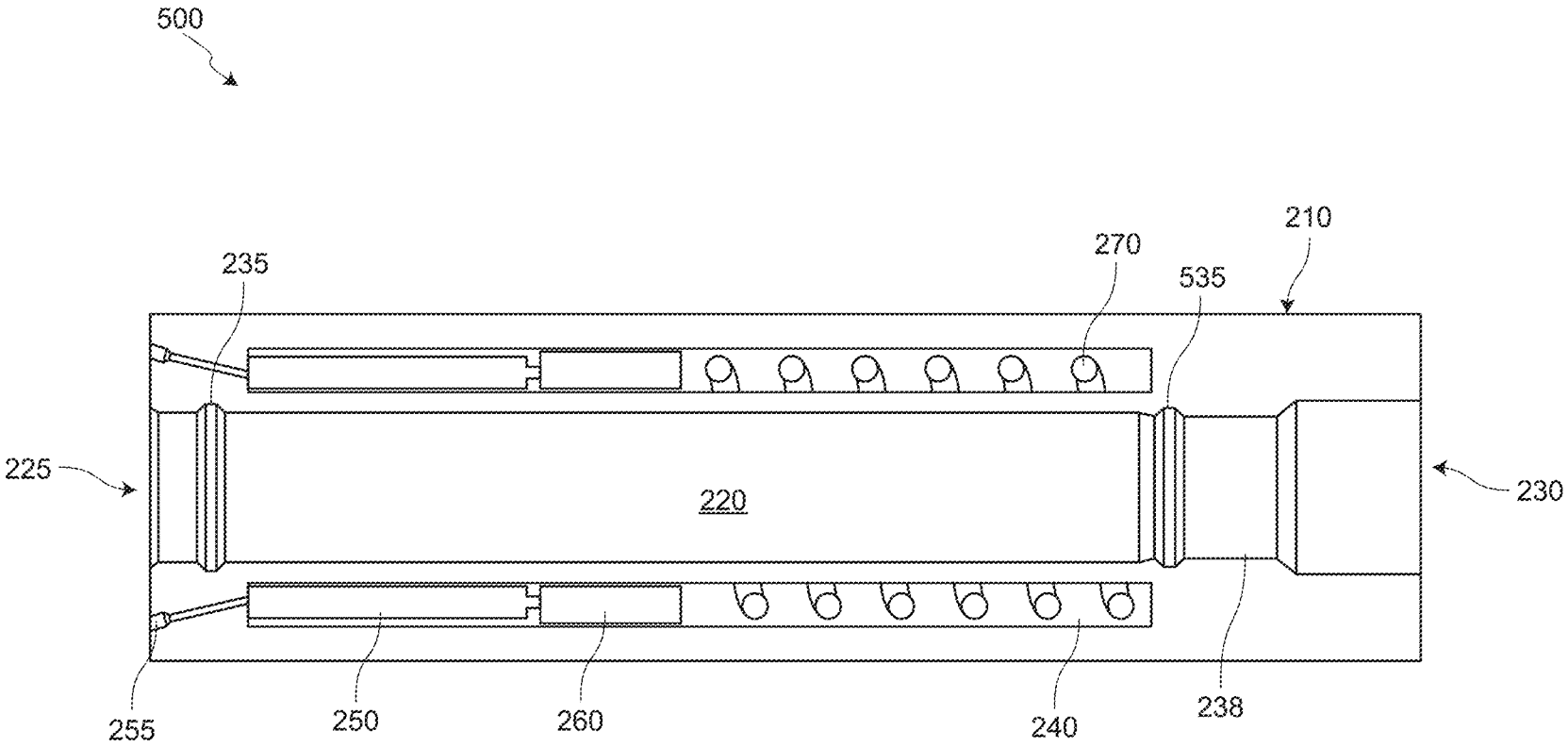
FIG. 5 illustrates one embodiment of a safety valve landing nipple, as might form part of an SSSV (e.g., SSSV of FIG. 1), designed and manufactured according to an alternative embodiment of the present disclosure.

Turning now to FIG. 5, illustrated is one embodiment of a safety valve landing nipple 500, as might form part of an SSSV (e.g., SSSV 170 of FIG. 1), designed and manufactured according to an alternative embodiment of the present disclosure. The safety valve landing nipple 500 is similar in many respects to the safety valve landing nipple 200 of FIG. 2. Accordingly, like reference numbers have been used to indicate similar, if not identical, features. The safety valve landing nipple 500 differs, for the most part, from the safety valve landing nipple 200, in that the safety valve landing nipple 500 includes a second latch profile 535 more proximate the second end 230. The second latch profile 535, in at least one embodiment, is a specifically designed latch profile configured to engage with a latch of a retrievable safety valve insert (e.g., the retrievable safety valve insert 600 of FIG. 6).

Turning now to FIG. 6, illustrated is one embodiment of a retrievable safety valve insert 600, as might form part of an SSSV (e.g., SSSV 170 of FIG. 1), designed and manufactured according to an alternative embodiment of the present disclosure. The retrievable safety valve insert 600 is similar in many respects to the retrievable safety valve insert 300 of FIG. 3. Accordingly, like reference numbers have been used to indicate similar, if not identical, features. The retrievable safety valve insert 600 differs, for the most part, from the retrievable safety valve insert 300, in that the outer housing 610 of the retrievable safety valve insert 600 does not surround and fix the landing nipple locking feature 650 with the bore flow management actuator 330 and the one or more safety valve insert magnets 340. As the landing nipple locking feature 650, and the bore flow management actuator 330 and one or more safety valve insert magnets 340 are separate and distinct features, the retrievable safety valve insert 600 further includes a second locking feature 670 for fixing the outer housing 310 relative to the safety valve landing nipple (e.g., using the second latch profile 535 in the safety valve landing nipple 500 of FIG. 5).

The retrievable safety valve insert 600 of FIG. 6 allows for increased coupling force for the one or more safety valve insert magnets and the one or more landing nipple magnets. Additionally, the retrievable safety valve insert 600 provides a larger ID than other designs. Such benefits may be provided as the second locking feature 670 may function as the primary locking feature, which allows for removal of the outer housing 610 around the bore flow management actuator 330.

Turning now to FIGS. 7A through 7K, illustrated is an embodiment for assembling (e.g., completing downhole) and operating a SSSV 700 according to one or more alternative embodiments of the disclosure, including inserting and locking a retrievable safety valve insert 720*a* within a safety valve landing nipple 710. In the illustrated embodiment of FIGS. 7A through 7K, the safety valve landing nipple 710 is similar in many respects to the safety valve landing nipple 500 of FIG. 5, and thus like reference numbers have been used to indicate similar, if not identical, features. Similarly, in the illustrated embodiment of FIGS. 7A through 7H, the retrievable safety valve insert 720*a* is similar in many respects to the retrievable safety valve insert 600 of FIG. 6, and thus like reference numbers have been used to indicate similar, if not identical, features. While not illustrated, the safety valve landing nipple 710 might be interconnected between pairs of oilfield tubulars, for example between pairs of threaded joint tubing. Furthermore, while not shown, a downhole conveyance, such as wireline, slickline, coiled tubing, a wellbore tractor, etc. may be coupled to the retrievable safety valve insert 720*a* for placing, securing and retrieving the retrievable safety valve insert 720*a* within/from the safety valve landing nipple 710.

Figure 7A:
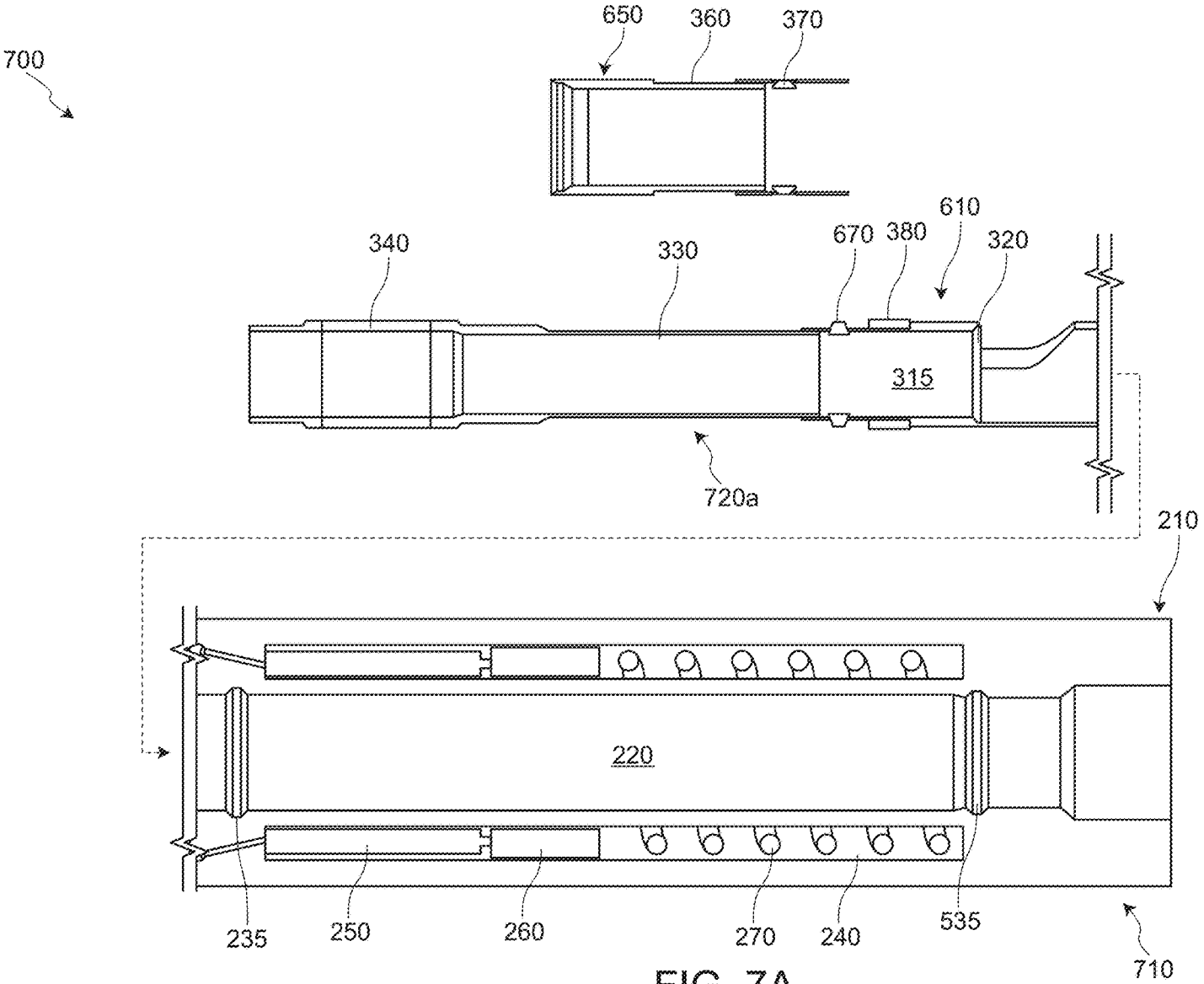

Referring to FIG. 7A, the safety valve landing nipple 710 and the retrievable safety valve insert 720*a* are separate from one another, for example as they might be positioned as the retrievable safety valve insert 720*a* were travelling down the wellbore toward the safety valve landing nipple 710. As shown in the embodiment of FIG. 7A, the actuator 250 of the safety valve landing nipple 710 is in a first actuator state. As further shown in the embodiment of FIG. 7A, the valve closure mechanism 320 and the bore flow management actuator 330 of the retrievable safety valve insert 720*a* are in the closed state. Furthermore, the one or more locking features 370 of the retrievable safety valve insert 720*a* may be in the radially retracted state, as the sliding sleeve 360 has yet to slide to move the one or more locking features 370 to the radially extended state. Additionally, the second locking feature 670 may be in the radially retracted state, as the bore flow management actuator 330 has yet to slide to move the second locking feature 670 to the radially extended state.

Figure 7B:
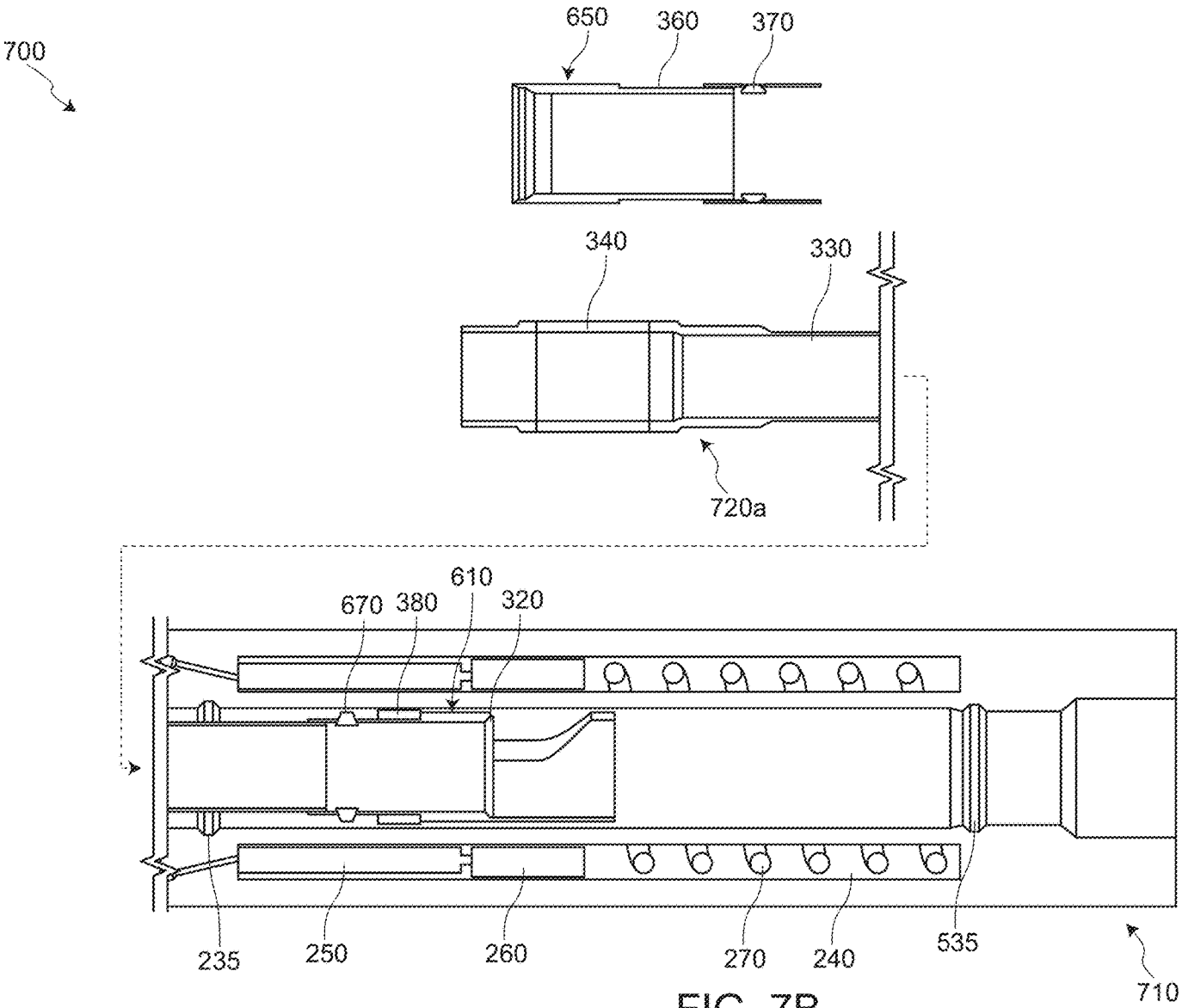

Referring to FIG. 7B, illustrated is the SSSV 700 of FIG. 7A after a small portion of the retrievable safety valve insert 720*a* has entered the safety valve landing nipple 710. In the embodiment of FIG. 7B, a downhole end of the retrievable safety valve insert 720*a* is approaching the one or more landing nipple magnets 260. The safety valve landing nipple 710 and the retrievable safety valve insert 720*a* are in substantially the same operational configuration in FIG. 7B as they were in FIG. 7A, but for the small portion of the retrievable safety valve insert 720*a* having entered the safety valve landing nipple 710.

Figure 7C:
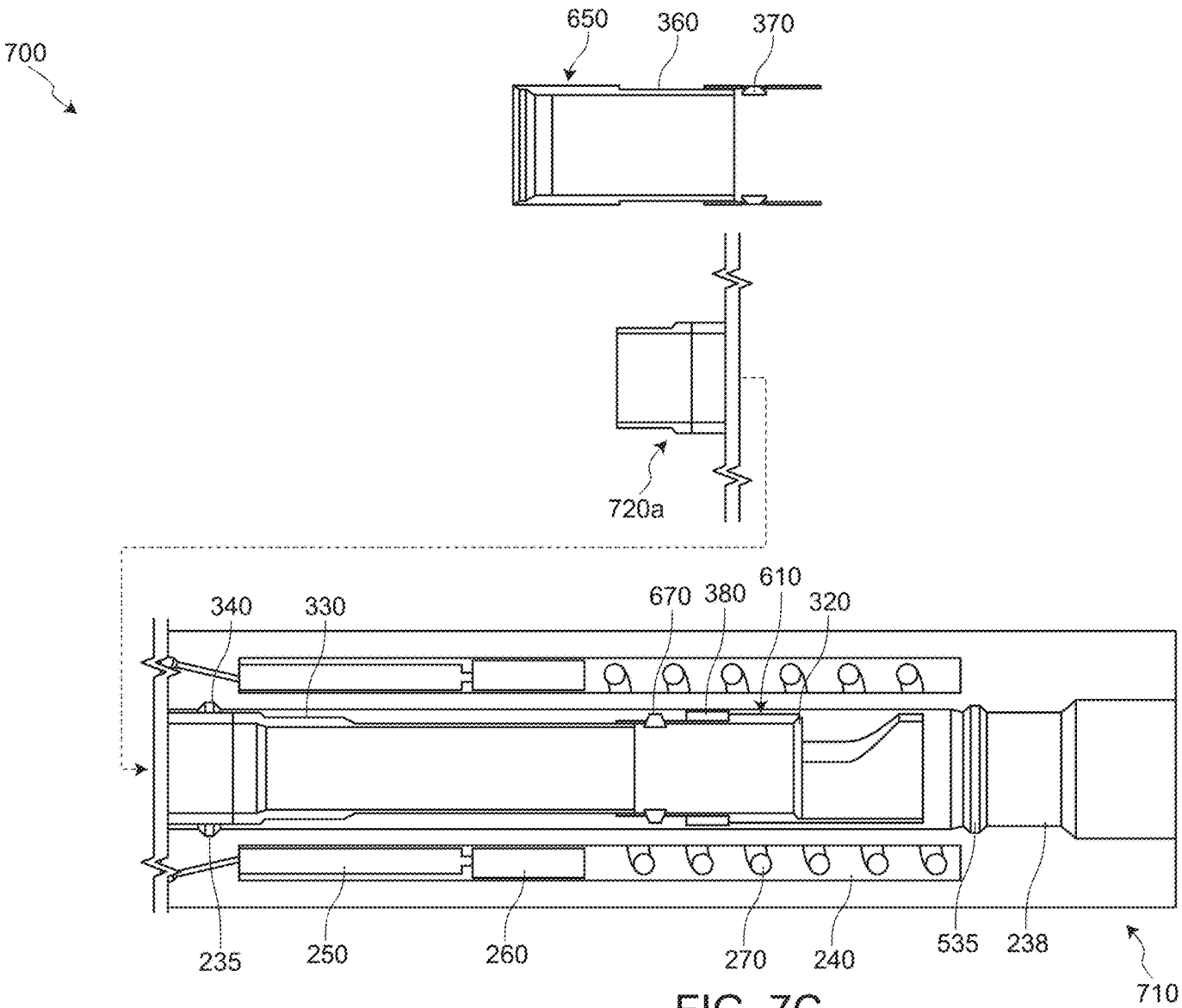

Referring to FIG. 7C, illustrated is the SSSV 700 of FIG. 7B after a significant portion of the retrievable safety valve insert 720*a* has entered the safety valve landing nipple 710. In the embodiment of FIG. 7C, a downhole end of the retrievable safety valve insert 720*a* is approaching the polished bore receptacle 238. The safety valve landing nipple 710 and the retrievable safety valve insert 720*a* are in substantially the same operational configuration in FIG. 7C as they were in FIG. 7B, but for the significant portion of the retrievable safety valve insert 720*a* having entered the safety valve landing nipple 710.

Figure 7D:
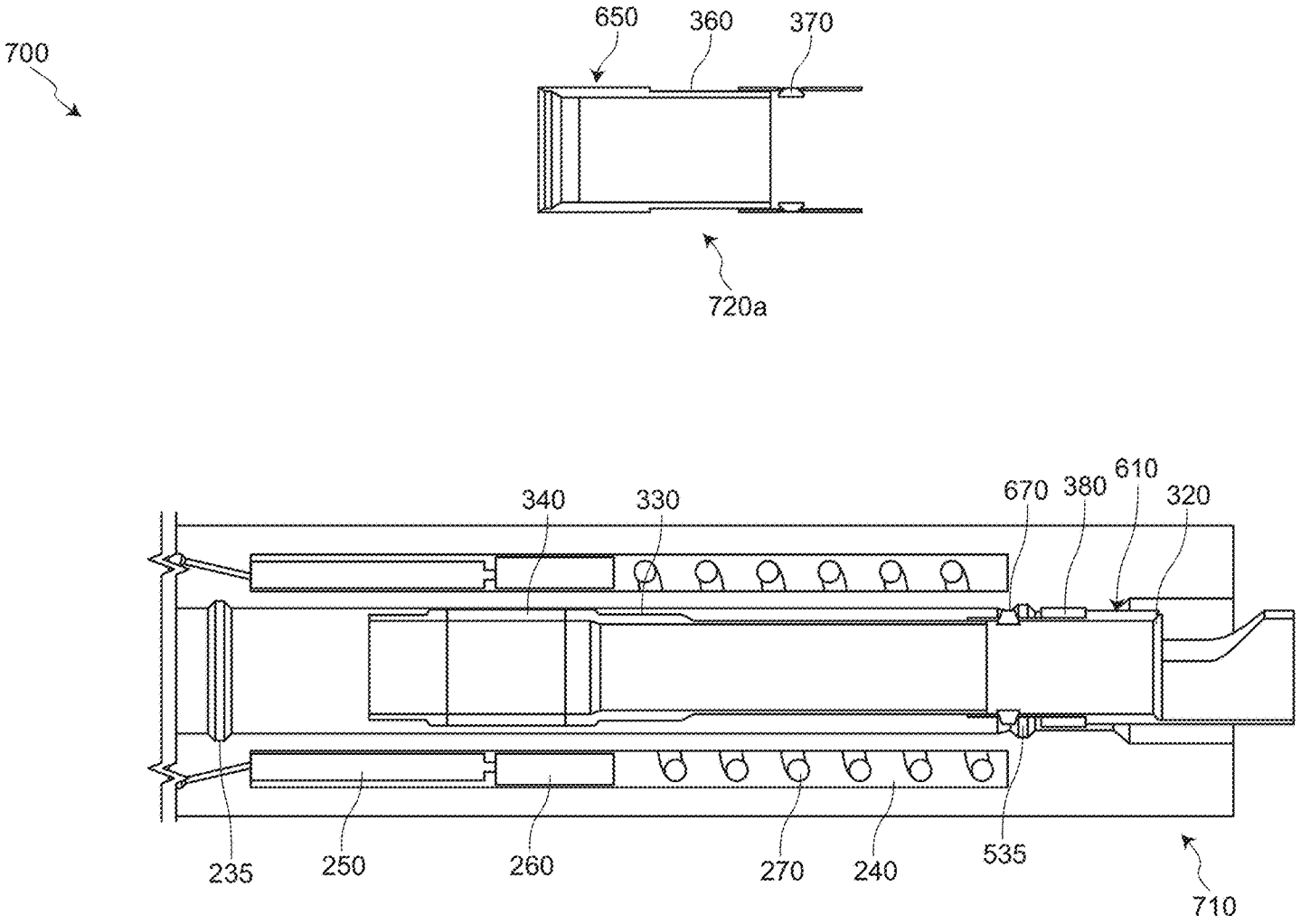

Referring to FIG. 7D, illustrated is the SSSV 700 of FIG. 7C after almost all of the retrievable safety valve insert 720*a* has entered the safety valve landing nipple 710. For instance, the landing nipple locking feature 650 remains outside of the safety valve landing nipple 710, but the second locking feature 670 is approaching the second latch profile 535. The safety valve landing nipple 710 and the retrievable safety valve insert 720*a* are in substantially the same operational configuration in FIG. 7D as they were in FIG. 7C, but for almost all of the retrievable safety valve insert 720*a* having entered the safety valve landing nipple 710.

Figure 7E:
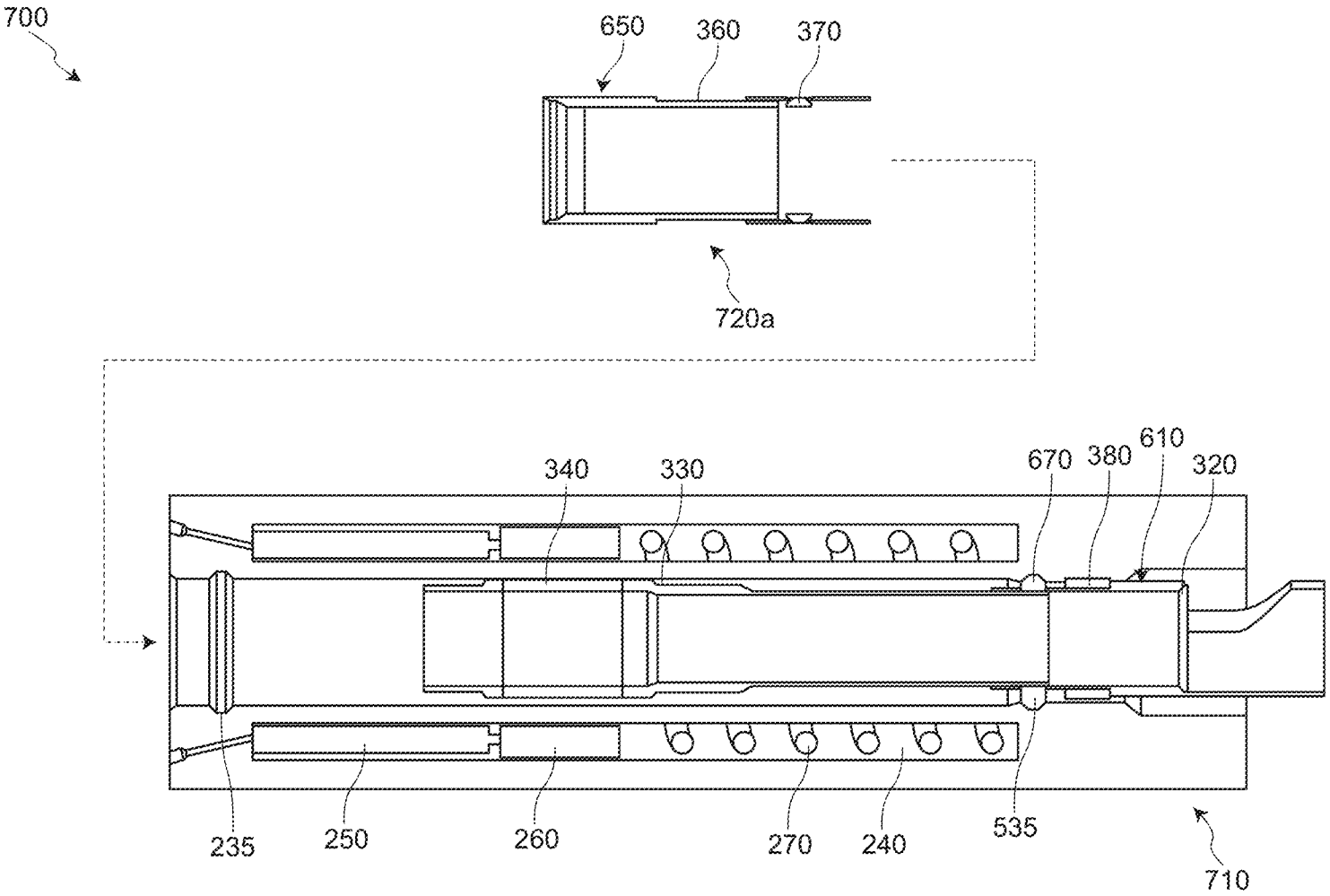

Referring to FIG. 7E, illustrated is the SSSV 700 of FIG. 7D after the second locking feature 670 is located under the second latch profile 535, and the bore flow management actuator 330 has slid down moving the second locking feature 670 from the radially retracted state to the radially extended state. Accordingly, the second locking feature 670 now engages with the second latch profile 535. Furthermore, the one or more safety valve insert magnets 340 are now magnetically coupled to the one or more landing nipple magnets 260. Additionally, the one or more seals 380 are in sealing engagement with the polished bore receptacle 238.

Figure 7F:
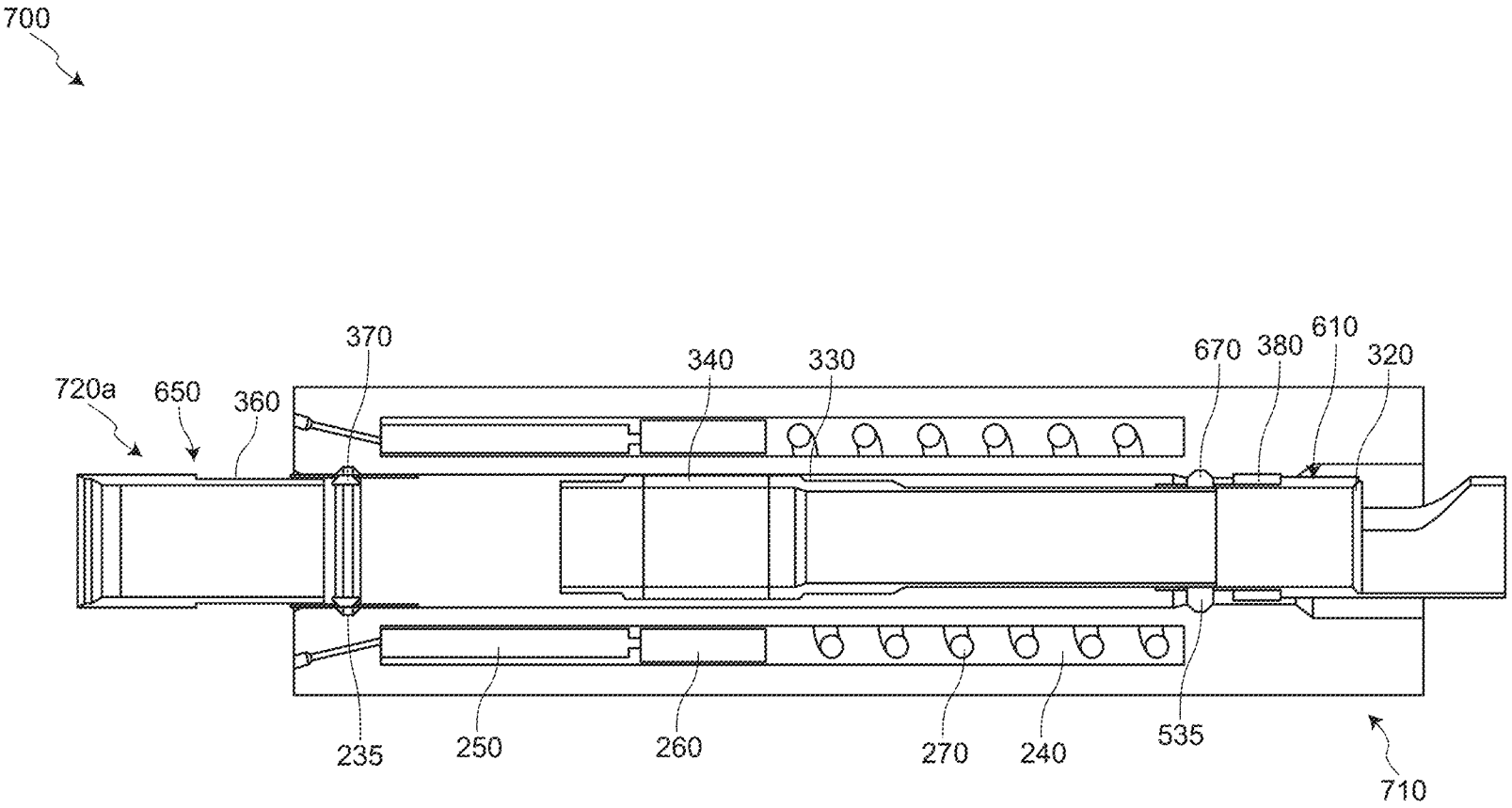

Referring to FIG. 7F, illustrated is the SSSV 700 of FIG. 7E after moving the landing nipple locking feature 650 at least partially into the safety valve landing nipple 710. In the illustrated embodiment, locking feature 370 is located under the latch profile 235, but the locking feature 370 remains in the radially retracted state.

Figure 7G:
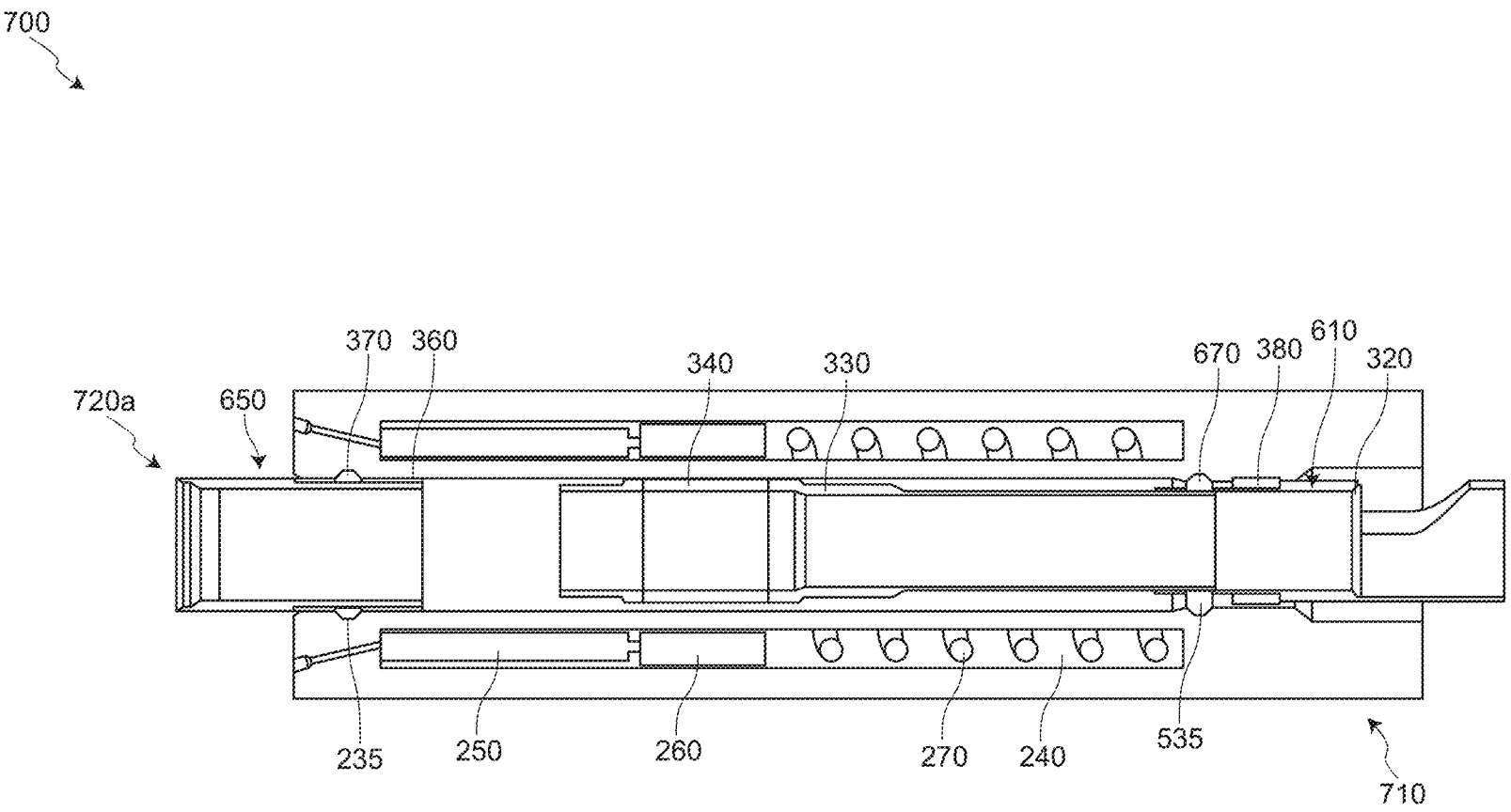

Referring to FIG. 7G, illustrated is the SSSV 700 of FIG. 7F after the sliding sleeve 360 has slid down moving the locking feature 370 from the radially retracted state to the radially extended state. Accordingly, the locking feature 370 now engages with the latch profile 235. Thus, the SSSV 700 is now assembled and operational.

Figure 7H:
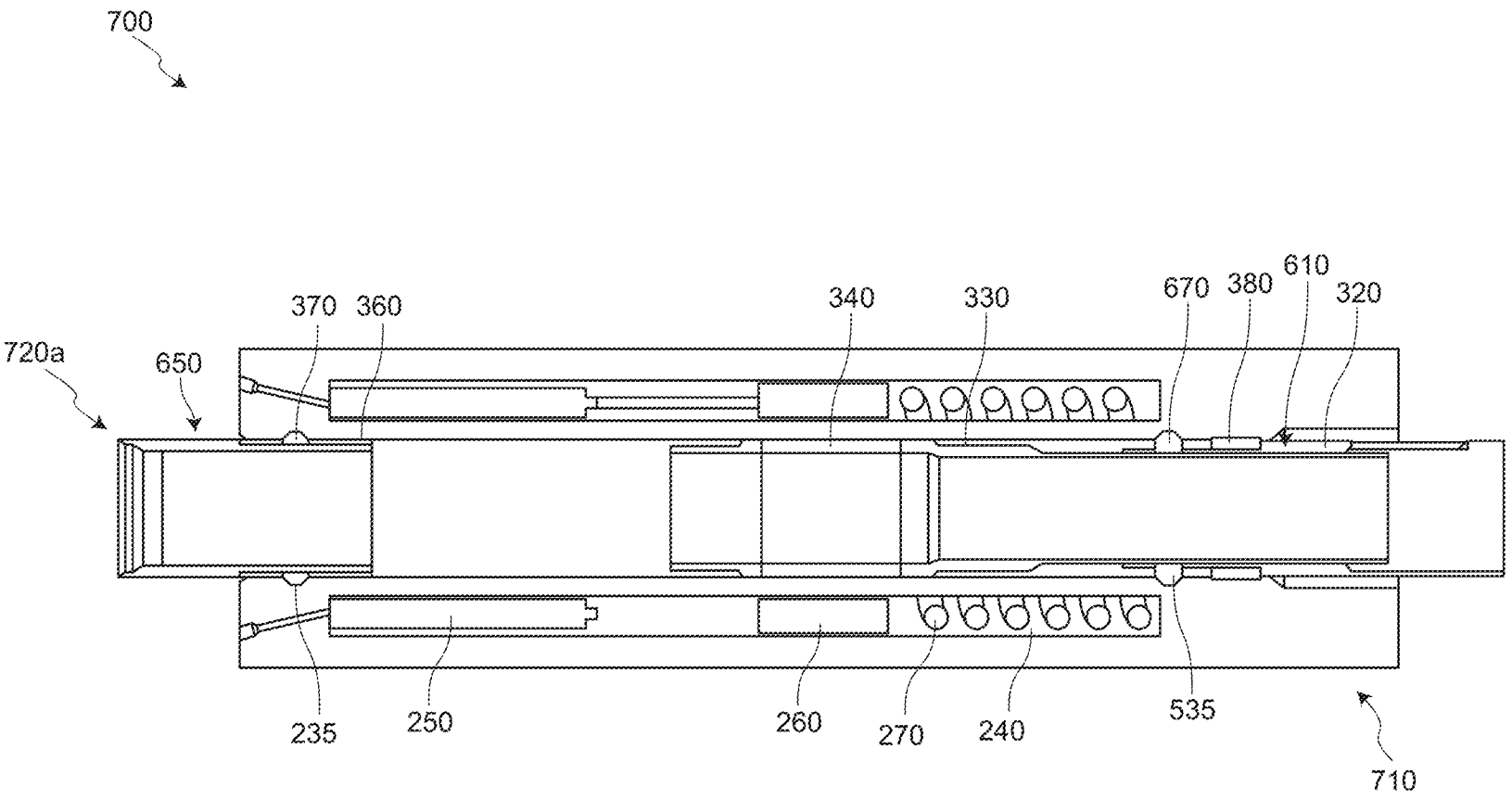

Referring to FIG. 7H, illustrated is the SSSV 700 of FIG. 7G after the actuator 250 has moved from the first actuator state to the second actuator state. In doing so, the actuator 250 has moved the one or more landing nipple magnets 260 from the first landing nipple magnet state to the second landing nipple magnet state. Moreover, as the one or more safety valve insert magnets 340 are magnetically coupled to the one or more landing nipple magnets 260, the one or more safety valve insert magnets 340 move from the first safety valve insert magnet state to the second safety valve insert magnet state. Additionally, as the bore flow management actuator 330 is coupled to the one or more safety valve insert magnets 340, the bore flow management actuator 330 moves from the closed state to the open state, the open state allowing subterranean production fluid to travel through the SSSV 700.

Figure 7I:
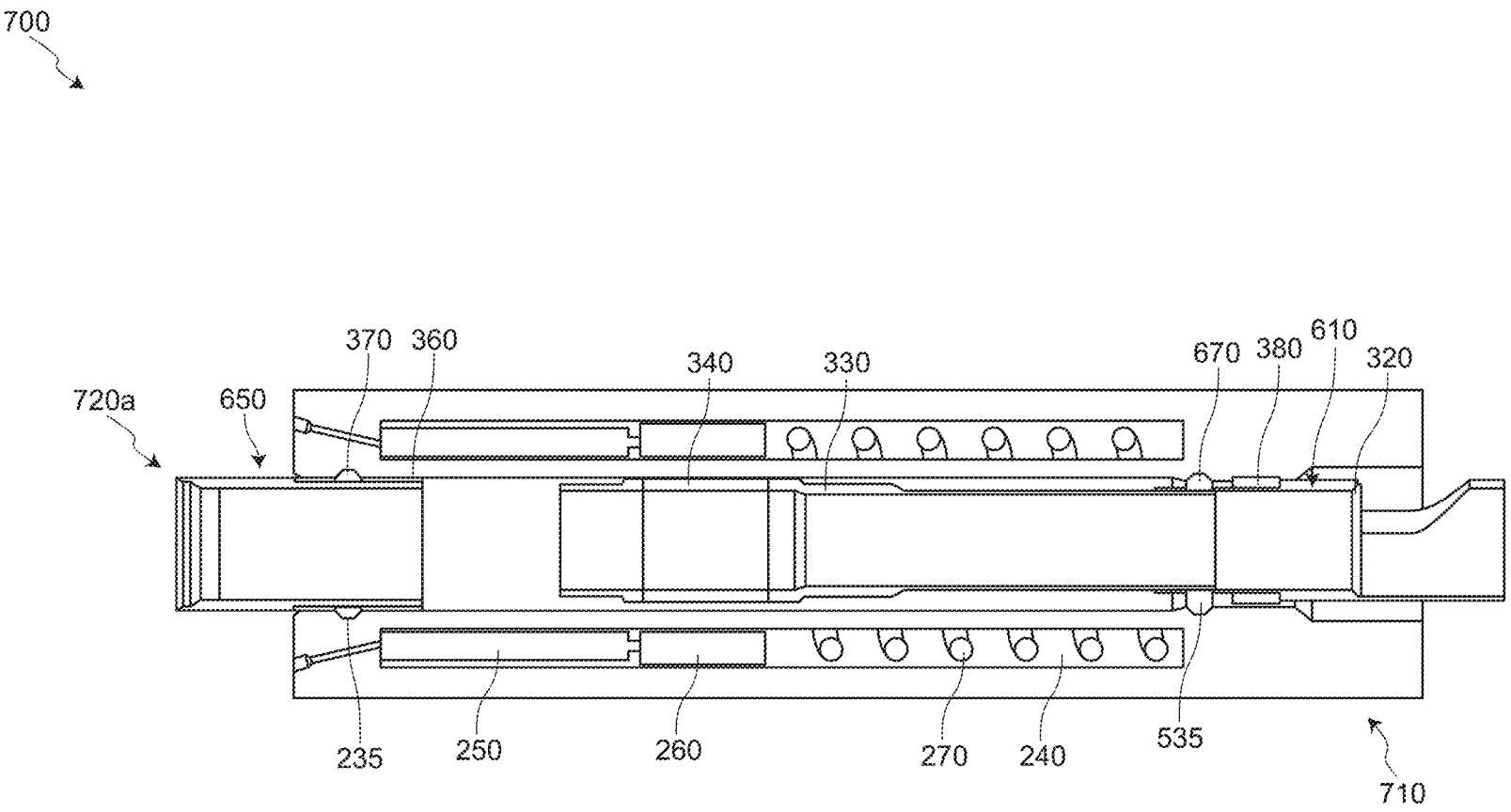

Referring to FIG. 7I, illustrated is the SSSV 700 of FIG. 7H after the actuator 250 has moved from the second actuator state back to the first actuator state. In doing so, the actuator 250 (e.g., and/or the power spring 270) has moved the one or more landing nipple magnets 260 from the second landing nipple magnet state back to the first landing nipple magnet state. Moreover, as the one or more safety valve insert magnets 340 are magnetically coupled to the one or more landing nipple magnets 260, the one or more safety valve insert magnets 340 move from the second safety valve insert magnet state back to the first safety valve insert magnet state. Additionally, as the bore flow management actuator 330 is coupled to the one or more safety valve insert magnets 340, the bore flow management actuator 330 moves from the open state back to the closed state, the closed state preventing subterranean production fluid from travelling through the SSSV 700.

Figure 7J:
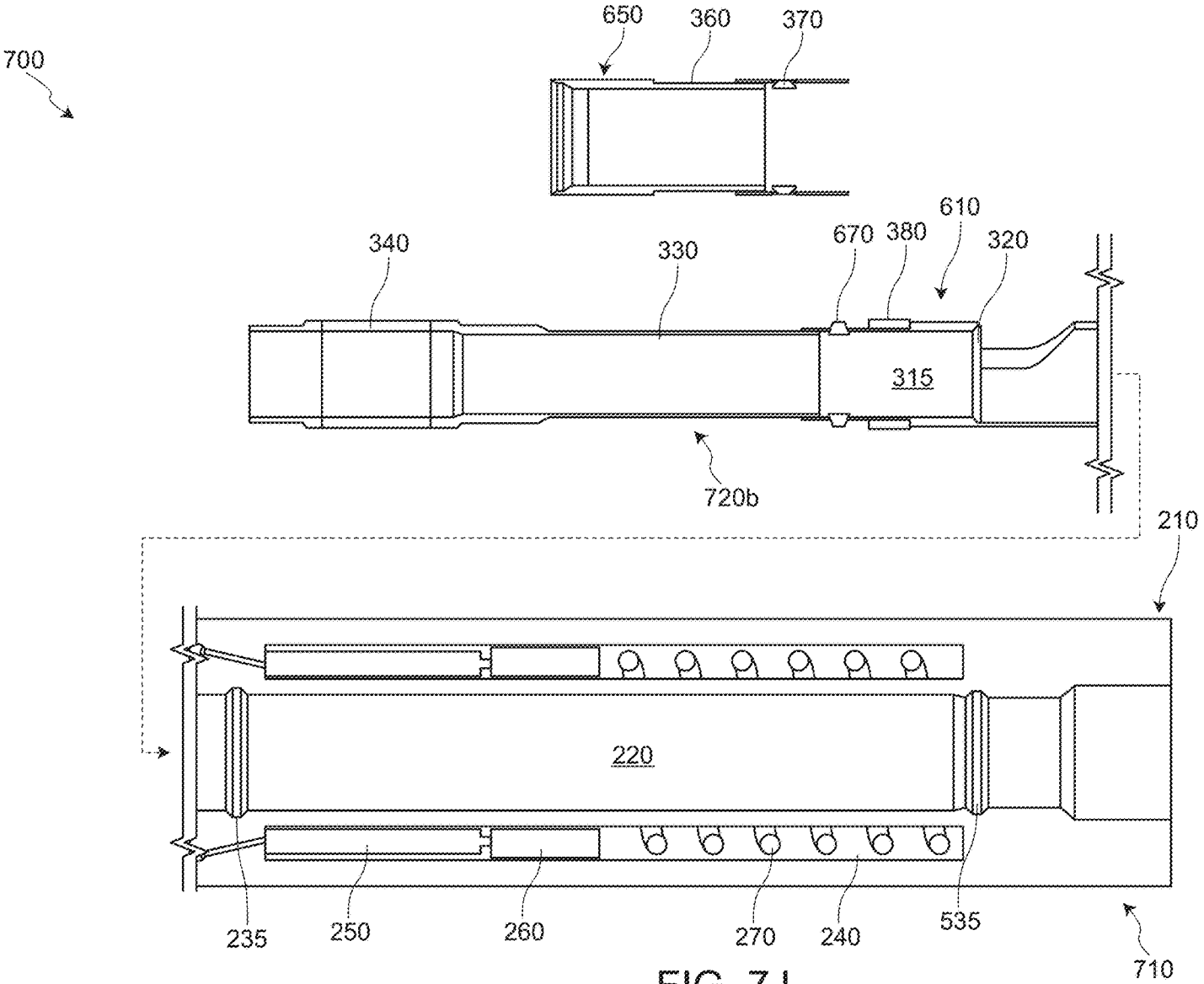

Referring to FIG. 7J, illustrated is the SSSV 700 of FIG. 7I after the retrievable safety valve insert 720*a* has been removed from the safety valve landing nipple 710, and a replacement retrievable safety valve insert 720*b* is being installed within the safety valve landing nipple 710. The replacement retrievable safety valve insert 720*b* is similar in many respects to the retrievable safety valve insert 720*a*. Accordingly, like reference numbers have been used to indicate similar, if not identical, features.

Figure 7K:
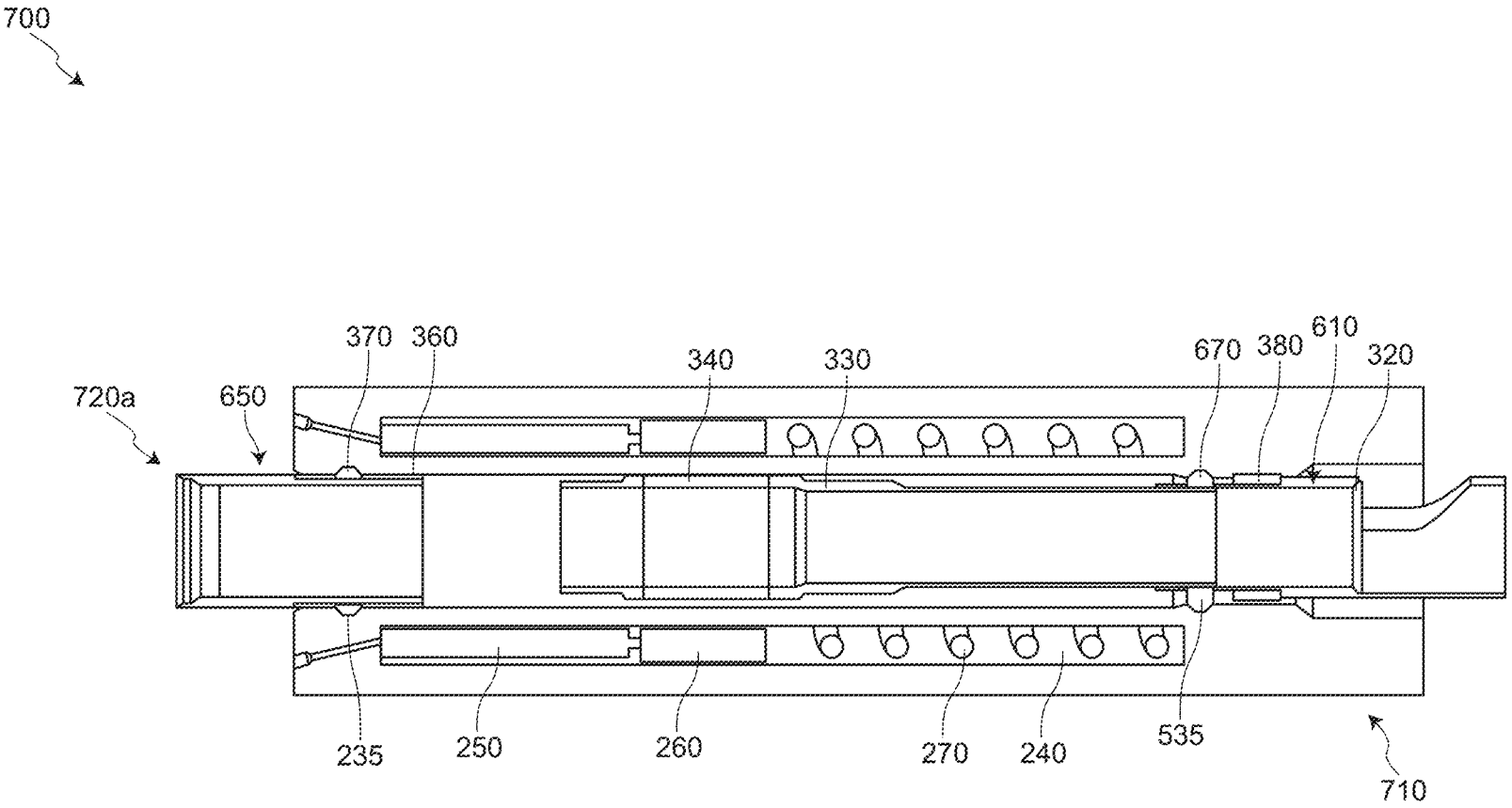

Referring to FIG. 7K, illustrated is the SSSV 700 of FIG. 7J after the replacement retrievable safety valve insert 720*b* is fully assembled within the safety valve landing nipple 710. Accordingly, the SSSV 700 is now assembled and operational with the replacement retrievable safety valve insert 720*b*.

Aspects disclosed herein include:

A. A retrievable safety valve insert, the retrievable safety valve insert including: 1) an outer housing including a central bore extending axially through the outer housing, the central bore operable to convey subsurface production fluids there through; 2) a valve closure mechanism coupled to the outer housing proximate a downhole end of the central bore; 3) a bore flow management actuator disposed in the central bore, the bore flow management actuator configured to slide to move the valve closure mechanism between a closed state and an open state; and 4) one or more safety valve insert magnets coupled to the bore flow management actuator, the one or more safety valve insert magnets configured to magnetically couple with one or more landing nipple magnets of a safety valve landing nipple to slide the bore flow management actuator and move the valve closure mechanism between the closed state and the open state.

B. A safety valve landing nipple, the safety valve landing nipple including: 1) a housing having a passageway extending from a first end to a second end thereof; 2) an isolated chamber located in the housing; 3) an actuator positioned within the isolated chamber; and 4) one or more landing nipple magnets coupled to the actuator within the isolated chamber, the one or more landing nipple magnets configured to move from a first landing nipple magnet state to a second landing nipple state when the actuator moves from a first actuator state to a second actuator state, the one or more landing nipple magnets configured to magnetically coupled to one or more safety valve insert magnets located in the passageway.

C. A well system, the well system including: 1) a wellbore extending through one or more subterranean formations; 2) production tubing disposed in the wellbore; 3) a subsurface safety valve (SSSV) disposed in line with the production tubing, the subsurface safety valve (SSSV) including: a) a safety valve landing nipple, the safety valve landing nipple including a housing having a passageway extending from a first end to a second end thereof; and b) a retrievable safety valve insert located within the safety valve landing nipple, the retrievable safety valve insert including: i) an outer housing including a central bore extending axially through the outer housing, the central bore operable to convey subsurface production fluids there through; ii) a valve closure mechanism coupled to the outer housing proximate a downhole end of the central bore; iii) a bore flow management actuator disposed in the central bore, the bore flow management actuator configured to slide to move the valve closure mechanism between a closed state and an open state; and iv) one or more safety valve insert magnets coupled to the bore flow management actuator, the one or more safety valve insert magnets magnetically coupled with one or more landing nipple magnets of the safety valve landing nipple to slide the bore flow management actuator and move the valve closure mechanism between the closed state and the open state.

D. A method for assembling and operating a subsurface safety valve (SSSV), the method including: 1) positioning a safety valve landing nipple disposed in line with production tubing in a wellbore, the safety valve landing nipple including: a) a housing having a passageway extending from a first end to a second end thereof; b) an isolated chamber located in the housing; c) an actuator located in the isolated chamber; and d) one or more landing nipple magnets coupled to the actuator in the isolated chamber; and 2) inserting a retrievable safety valve insert within the safety valve landing nipple located in the wellbore, the retrievable safety valve insert including: a) an outer housing comprising a central bore extending axially through the outer housing, the central bore operable to convey subsurface production fluids there through; b) a valve closure mechanism coupled to the outer housing proximate a downhole end of the central bore; c) a bore flow management actuator disposed in the central bore, the bore flow management actuator configured to slide to move the valve closure mechanism between a closed state and an open state; and d) one or more safety valve insert magnets coupled to the bore flow management actuator, the one or more safety valve insert magnets configured to magnetically couple with the one or more landing nipple magnets of the safety valve landing nipple to slide the bore flow management actuator and move the valve closure mechanism between the closed state and the open state.

Aspects A, B, and C may have one or more of the following additional elements in combination: Element 1: further including a landing nipple locking feature. Element 2: wherein the landing nipple locking feature includes a sliding sleeve and one or more locking features, the one or more locking features configured to engage with one or more latch profiles in the safety valve landing nipple. Element 3: wherein the sliding sleeve is configured to slide to move the one or more locking features from a radially retracted state to a radially extended state to engage with the one or more latch profiles in the safety valve landing nipple. Element 4: wherein the outer housing entirely surrounds the bore flow management actuator and couples to and surrounds at least a portion of the landing nipple locking feature. Element 5: wherein the landing nipple locking feature is slidingly fixed to the bore flow management actuator. Element 6: wherein the one or more locking features are configured to extend through the outer housing to engage with the one or more latch profiles in the safety valve landing nipple. Element 7: wherein the landing nipple locking feature and the bore flow management actuator are separate and distinct features. Element 8: wherein the one or more locking features are one or more first locking features for removably fixing the landing nipple locking feature to the safety valve landing nipple, and further including one or more second locking features located proximate a downhole end of the retrievable safety valve, the one or more second locking features configured to engage with one or more second latch profiles in the safety valve landing nipple for removably fixing the outer housing to the safety valve landing nipple. Element 9: further including one or more seals disposed radially about the outer housing, the one or more seals configured to engage with a polished bore receptacle of the safety valve landing nipple. Element 10: further including a power spring located in the isolated chamber and coupled to the one or more landing nipple magnets, the power spring configured to return the one or more landing nipple magnets from the second landing nipple magnet state to the first landing nipple magnet state. Element 11: further including a latch profile located in the passageway, the latch profile configure to engage with a latch of a retrievable safety valve insert. Element 12: wherein the latch profile is a first latch profile located proximate the first end, and further including a second latch profile located proximate the second end. Element 13: further including a polished bore receptacle located proximate the second end, the polished bore receptacle configured to engage with a seal of a retrievable safety valve insert. Element 14: wherein the retrievable safety valve insert further includes a landing nipple locking feature, the landing nipple locking feature including a sliding sleeve and one or more locking features, and further including sliding the sliding sleeve to move the one or more locking features from a radially retraced state to a radially extended state to engage with one or more latch profiles in the safety valve landing nipple. Element 15: wherein inserting a retrievable safety valve insert within the safety valve landing nipple includes magnetically coupling the one or landing nipple magnets with the one or more safety valve insert magnets. Element 16: further including actuating the actuator to move the landing nipple magnets from a first landing nipple magnet state to a second landing nipple state and in turn move the one or more safety valve magnets from a first safety valve insert magnet state to a second safety valve insert magnet state and the bore flow management actuator to move the valve closure mechanism from the closed state to the open state. Element 17: further including removing the retrievable safety valve insert from within the safety valve landing nipple, and then inserting a replacement retrievable safety valve insert within the safety valve landing nipple. Element 18: wherein the inserting and the removing including using a wireline, coiled tubing or a wellbore tractor to replace and remove. Element 19: wherein the inserting the retrievable safety valve insert within the safety valve landing nipple includes inserting the retrievable safety valve insert within the safety valve landing nipple in a single downhole trip. Element 20: wherein the inserting the retrievable safety valve insert within the safety valve landing nipple includes inserting the retrievable safety valve insert within the safety valve landing nipple in two downhole trips.

Those skilled in the art to which this application relates will appreciate that other and further additions, deletions, substitutions and modifications may be made to the described embodiments.

What is claimed is:

1. A retrievable safety valve insert, comprising:

an outer housing including a central bore extending axially through the outer housing, the central bore operable to convey subsurface production fluids there through;

a valve closure mechanism coupled to the outer housing proximate a downhole end of the central bore;

a bore flow management actuator disposed in the central bore, the bore flow management actuator configured to slide to move the valve closure mechanism between a closed state and an open state;

one or more safety valve insert magnets coupled to the bore flow management actuator, the one or more safety valve insert magnets configured to magnetically couple with one or more landing nipple magnets of a safety valve landing nipple to slide the bore flow management actuator and move the valve closure mechanism between the closed state and the open state; and a landing nipple locking feature, the landing nipple locking feature including a sliding sleeve and one or more locking features, the one or more locking features configured to engage with one or more latch profiles in the safety valve landing nipple, the sliding sleeve configured to slide to move the one or more locking features from a radially retracted state to a radially extended state to engage with the one or more latch profiles in the safety valve landing nipple.

2. The retrievable safety valve insert as recited in claim 1, wherein the outer housing entirely surrounds the bore flow management actuator and couples to and surrounds at least a portion of the landing nipple locking feature.

3. The retrievable safety valve insert as recited in claim 2, wherein the landing nipple locking feature is slidingly fixed to the bore flow management actuator.

4. The retrievable safety valve insert as recited in claim 2, wherein the one or more locking features are configured to extend through the outer housing to engage with the one or more latch profiles in the safety valve landing nipple.

5. The retrievable safety valve insert as recited in claim 1, wherein the landing nipple locking feature and the bore flow management actuator are separate and distinct features.

6. The retrievable safety valve insert as recited in claim 5, wherein the one or more locking features are one or more first locking features for removably fixing the landing nipple locking feature to the safety valve landing nipple, and further including one or more second locking features located proximate a downhole end of the retrievable safety valve, the one or more second locking features configured to engage with one or more second latch profiles in the safety valve landing nipple for removably fixing the outer housing to the safety valve landing nipple.

7. The retrievable safety valve insert as recited in claim 1, further including one or more seals disposed radially about the outer housing, the one or more seals configured to engage with a polished bore receptacle of the safety valve landing nipple.

8. A well system, comprising:

a wellbore extending through one or more subterranean formations;

production tubing disposed in the wellbore;

a subsurface safety valve (SSSV) disposed in line with the production tubing, the subsurface safety valve (SSSV) including:

a safety valve landing nipple, the safety valve landing nipple including a housing having a passageway extending from a first end to a second end thereof; and a retrievable safety valve insert located within the safety valve landing nipple, the retrievable safety valve insert including:

an outer housing including a central bore extending axially through the outer housing, the central bore operable to convey subsurface production fluids there through;

a valve closure mechanism coupled to the outer housing proximate a downhole end of the central bore;

a bore flow management actuator disposed in the central bore, the bore flow management actuator configured to slide to move the valve closure mechanism between a closed state and an open state;

one or more safety valve insert magnets coupled to the bore flow management actuator, the one or more safety valve insert magnets magnetically coupled with one or more landing nipple magnets of the safety valve landing nipple to slide the bore flow management actuator and move the valve closure mechanism between the closed state and the open state; and a landing nipple locking feature, the landing nipple locking feature including a sliding sleeve and one or more locking features, the one or more locking features configured to engage with one or more latch profiles in the safety valve landing nipple, the sliding sleeve configured to slide to move the one or more locking features from a radially retracted state to a radially extended state to engage with the one or more latch profiles in the safety valve landing nipple.

9. The well system as recited in claim 8, wherein the outer housing entirely surrounds the bore flow management actuator and couples to and surrounds at least a portion of the landing nipple locking feature.

10. The well system as recited in claim 9, wherein landing nipple locking feature is slidingly fixed to the bore flow management actuator.

11. The well system as recited in claim 9, wherein the one or more locking features are configured to extend through the outer housing to engage with the one or more latch profiles in the safety valve landing nipple.

12. The well system as recited in claim 8, wherein the landing nipple locking feature and the bore flow management actuator are separate and distinct features.

13. The well system as recited in claim 12, wherein the one or more locking features are one or more first locking features for removably fixing the landing nipple locking feature to the safety valve landing nipple, and further including one or more second locking features located proximate a downhole end of the retrievable safety valve, the one or more second locking features configured to engage with one or more second latch profiles in the safety valve landing nipple.

14. The well system as recited in claim 8, further including one or more seals disposed radially about the outer housing, the one or more seals configured to engage with a polished bore receptacle of the safety valve landing nipple.

15. The well system as recited in claim 8, wherein the housing of the safety valve landing nipple includes an isolated chamber, the isolated chamber including an actuator coupled to the one or more landing nipple magnets for moving the one or more landing nipple magnets from a first landing nipple magnet state to a second landing nipple magnet state.

16. The well system as recited in claim 15, further including a power spring located in the isolated chamber and coupled to the one or more landing nipple magnets, the power spring configured to return the one or more landing nipple magnets from the second landing nipple magnet state to the first landing nipple magnet state.

17. A method for assembling and operating a subsurface safety valve (SSSV), comprising:

positioning a safety valve landing nipple disposed in line with production tubing in a wellbore, the safety valve landing nipple including:

a housing having a passageway extending from a first end to a second end thereof;

an isolated chamber located in the housing;

an actuator located in the isolated chamber; and one or more landing nipple magnets coupled to the actuator in the isolated chamber; and inserting a retrievable safety valve insert within the safety valve landing nipple located in the wellbore, the retrievable safety valve insert including:

an outer housing comprising a central bore extending axially through the outer housing, the central bore operable to convey subsurface production fluids there through;

a valve closure mechanism coupled to the outer housing proximate a downhole end of the central bore;

a bore flow management actuator disposed in the central bore, the bore flow management actuator configured to slide to move the valve closure mechanism between a closed state and an open state;

one or more safety valve insert magnets coupled to the bore flow management actuator, the one or more safety valve insert magnets configured to magnetically couple with the one or more landing nipple magnets of the safety valve landing nipple to slide the bore flow management actuator and move the valve closure mechanism between the closed state and the open state; and a landing nipple locking feature, the landing nipple locking feature including a sliding sleeve and one or more locking features, the one or more locking features configured to engage with one or more latch profiles in the safety valve landing nipple, the sliding sleeve configured to slide to move the one or more locking features from a radially retracted state to a radially extended state to engage with the one or more latch profiles in the safety valve landing nipple.

18. The method as recited in claim 17, further including actuating the actuator to move the landing nipple magnets from a first landing nipple magnet state to a second landing nipple state and in turn move the one or more safety valve magnets from a first safety valve insert magnet state to a second safety valve insert magnet state and the bore flow management actuator to move the valve closure mechanism from the closed state to the open state.

19. The method as recited in claim 17, further including removing the retrievable safety valve insert from within the safety valve landing nipple, and then inserting a replacement retrievable safety valve insert within the safety valve landing nipple.

20. The method as recited in claim 19, wherein the inserting and the removing including using a wireline, coiled tubing or a wellbore tractor to replace and remove.

21. The method as recited in claim 17, wherein the inserting the retrievable safety valve insert within the safety valve landing nipple includes inserting the retrievable safety valve insert within the safety valve landing nipple in a single downhole trip.

22. The method as recited in claim 17, wherein the inserting the retrievable safety valve insert within the safety valve landing nipple includes inserting the retrievable safety valve insert within the safety valve landing nipple in two downhole trips.

* * * * *